US006011983A

United States Patent [19]

Ishikawa et al.

[11] Patent Number: 6,011,983

[45] Date of Patent: Jan. 4, 2000

[54] BAND-PASS FILTER APPARATUS USING SUPERCONDUCTING INTEGRATED NONRADIATIVE DIELECTRIC WAVEGUIDE

[75] Inventors: Yohei Ishikawa, Kyoto; Seiji Hidaka, Nagaokakyo; Norifumi Matsui, Kyoto, all of Japan

[73] Assignee: Murata Manufacturing Co., Ltd., Japan

[21] Appl. No.: 08/810,605

[22] Filed: Feb. 28, 1997

[30] Foreign Application Priority Data

Mar. 1, 1996 [JP] Japan ..... 8-044990

[51] Int. Cl.[7] ..... H01P 1/207; H01B 12/02

[52] U.S. Cl. ..... 505/210; 505/700; 505/866; 333/99.005; 333/208; 333/212; 333/248

[58] Field of Search ..... 333/208, 212, 333/239, 242, 248, 995; 505/210, 700, 701, 866

[56] References Cited

U.S. PATENT DOCUMENTS

| | | | |
|---|---|---|---|
| 4,097,826 | 6/1978 | Knox et al. | 333/208 X |
| 5,407,904 | 4/1995 | Das | 333/995 X |
| 5,473,296 | 12/1995 | Ishikawa et al. | 333/239 |

FOREIGN PATENT DOCUMENTS

| | | | |
|---|---|---|---|
| 59001 | 3/1988 | Japan | 333/208 |
| 1115142 | 9/1984 | U.S.S.R. | 333/208 |
| 9428592 | 12/1994 | WIPO . | |

OTHER PUBLICATIONS

Xu S et al. "Scattering Properties of Discontinuities in NRD Guide", IEEE Proceedings: Microwaves, Antennas and Propagation, vol. 141, No. 3, Part H, Jun. 1, 1994, pp. 205–210, XP000459827, Fig. 4A.

Cheng–Liang Huang et al. "Dielectric Waveguide with a YBA2CU306+X Boundary Layer at 94 GHZ" Journal of Applied Physics, vol. 67, No. 6, Mar. 15, 1990, pp. 3194–3196, XP000106029, p. 3195, left–hand column, line 24–right–hand column, line 8; Fig. 2.

*Primary Examiner*—Benny T. Lee

*Attorney, Agent, or Firm*—Ostrolenk, Faber, Gerb & Soffen, LLP

[57] ABSTRACT

An NRD waveguide band-pass filter apparatus is provided which is simple in construction, which can be easily manufactured as well as being small in size and light in weight, and which operates in a single operating mode. The NRD waveguide band-pass filter apparatus includes a plurality of NRD waveguide resonators arrayed in such a way that each two adjacent NRD waveguide resonators are electromagnetically coupled to each other. A plurality of arrayed rectangular dielectric waveguides are interposed between an upper surface portion and a lower surface portion of a rectangular dielectric housing, which are parallel to each other. The upper surface portion and the lower surface portion and the plurality of arrayed rectangular dielectric waveguides are formed integrally, thus forming the housing. A first superconducting electrode and a second superconducting electrode are formed on the outer surfaces of the upper surface portion and the lower surface portion, respectively. By setting the spacing between the first and second superconducting electrodes at one-half or less of the wavelength of the resonance frequency in a vacuum of the present apparatus, the portions outside of each dielectric waveguide form cut-off regions.

24 Claims, 25 Drawing Sheets

OTHER PUBLICATIONS

Kobayashi Y et al. "Intermodulation Characteristics of High–Power Bandpass Filter using Dielectric Rod Resonators Loaded in a High–TC Superconducting Cylinder"IEEE MTT–S International Microwave Symposium Digest, Orlando, May 16–20, 1995, vol. 2, May 16, 1995, Kirby L (Ed), pp. 733–736, XP000536980, p. 733, right–hand column, line 1–line 16; Figs. 1, 2.

Patent Abstracts of Japan, vol. 16, No. 88 (E–1173), Mar. 4 1992 & JP 03 270401 A (Murata Mfg. Co., Ltd.) Dec. 2, 1991, abstract.

T.H. Oxley et al. "Image Guide and Microstrip Integrated W–Band Recievers" Microwave Journal., vol. 26, No. 11, Nov. 1983, Dedham US, pp. 117–136, XP002064270, p. 117, right–hand column, line 7–line 20; Fig. 1A.

K. Solbach et al. "Slots as New Circuit–Elements in Dielectric Image Line" 1981 IEEE MTT–S International Microwave Symposium Digest, Jun. 15–19, 1981, Los Angeles (US), pp. 8–10, XP002064271, p. 8, right–hand column, line 1–line 5, Fig. 1C.

BAND-PASS FILTER APPARATUS USING SUPERCONDUCTING INTEGRATED NONRADIATIVE DIELECTRIC WAVEGUIDE

BACKGROUND OF THE INVENTION

1. Field of the Invention

The present invention relates to an integrated superconducting band-pass filter apparatus employing nonradiative dielectric waveguides (hereinafter referred to as "NRD waveguides").

2. Description of the Related Art

The following arrangement is disclosed in Japanese Unexamined Patent Publication No. 3-270401. An NRD waveguide (hereinafter referred to as a "first conventional example") is formed with upper and lower portions of a dielectric waveguide shaped, for example, in a quadrangular prism, which are interposed and held by a pair of flat metal plates. The vertical height of the dielectric member taken at right angles to the direction of its length is a half-wavelength or less, a brim is extended from one side to the other at the upper and lower end portions in order to form an H-shaped cross-section, and a metallic film is formed in close contact with the outer surfaces of both upper and lower ends of the dielectric member including the brim portion, thus forming a dielectric integrated NRD waveguide. Such a dielectric integrated NRD waveguide has a feature that even if vibration and/or impact are received, the metal section and the dielectric member are not separated from each other, and stable electrical characteristics can be obtained.

There has been proposed a dielectric-loaded waveguide filter or a waveguide-coupled NRD waveguide in which dielectric resonators at the initial and final stages are directly coupled to the waveguide. In the arrangement of such filters, there is a problem in that it is difficult to adjust the external Q and the resonance frequency independently from each other. In order to solve this problem, Japanese Unexamined Patent Publication No. 63-59001 proposes a waveguide-coupled NRD guide filter (hereinafter referred to as a "second conventional example") of a type in which an NRD guide resonator and a waveguide are directly coupled, wherein a buffer dielectric section is disposed in the connection portion of the NRD guide resonator and the waveguide, posterior to a resonator-forming dielectric section of the NRD guide resonator.

An NRD waveguide is formed by using low dielectric-constant materials as materials for dielectric waveguides of an NRD waveguide for use in the first and second conventional examples. If an NRD waveguide is formed by using high dielectric-constant materials for the purpose of achieving a smaller size, a phenomenon in which single mode transmission cannot be performed has been observed, as reported in Soube Shinohara et al., "Specific Transmission Characteristics of Nonradiative Dielectric Waveguide Using High Dielectric-Constant Materials", Journal of The Institute of Electronics, Information and Communication Engineers of Japan, C-I, Vol.J73-C-I, No.11, pp.716–723, November 1990). The reason why single mode transmission cannot be performed in the conventional NRD waveguide is that a very small gap between the dielectric strip and the metal plate of the NRD waveguide, which cannot be avoided in the manufacturing process, narrows the band of single mode transmission. In order to solve this problem, in Shinohara et al., a "trapped insular guide" (hereinafter referred to as a "third conventional example") has been proposed as a structural scheme for an arrangement using high dielectric-constant materials. However, this third conventional example has a problem in that the arrangement is complex, and the manufacturing steps are complex, resulting in a considerable increase in the manufacturing cost.

SUMMARY OF THE INVENTION

An advantage of the present invention is that it is able to provide an NRD waveguide band-pass filter apparatus which solves the above-described problems, which is simple in construction and can be manufactured easily as well as being small in size and light in weight, and which operates in a single operating mode.

To achieve the above-described advantage, according to a first aspect of the present invention, there is provided an integrated NRD waveguide superconducting band-pass filter apparatus having a plurality of NRD waveguide resonators arrayed in such a way that each two adjacent NRD waveguide resonators are electromagnetically coupled to each other. The apparatus comprises: a hollow dielectric housing which is rectangular in cross-section and comprises an upper surface portion and a lower surface portion which are parallel to each other, and a plurality of arrayed dielectric waveguides, which are rectangular in cross-section and enclosed by the upper and lower surface portions; the upper and lower surface portions and the plurality of dielectric sections being formed integrally; first and second superconducting electrodes formed respectively on the outer surfaces of the upper surface portion and the lower surface portion, wherein the portions outside of each dielectric waveguide are formed into cut-off regions by setting the spacing between the first and second superconducting electrodes to one-half of the wavelength of the resonance frequency in vacuum of the band-pass filter apparatus.

According to a second aspect of the present invention, the dielectric housing further comprises two end surface portions formed in such a manner as to connect both longitudinal ends of the upper surface portion and the lower surface portion, and the band-pass filter apparatus further comprises third and fourth superconducting electrodes or metallic electrodes formed respectively on the outer surfaces of the two end surface portions.

According to a third aspect of the present invention, the connection portions between the upper surface portion, the lower surface portion the two end surface portions of the dielectric housing, and the connection portions between each dielectric waveguide and the upper and lower surface portions are chamfered, sloped, or curved.

According to a fourth aspect of the present invention, the band-pass filter apparatus further comprises a plane circuit formed on the outer surface of the upper surface portion.

The above and further objects, aspects and novel features of the invention will become more apparent from the following detailed description when read in connection with the accompanying drawings. In the drawings, like reference labels and numbers indicate like elements and parts and are not necessarily described in detail for all figures in which they appear.

DETAILED DESCRIPTION OF EMBODIMENTS OF THE INVENTION

Embodiments of the present invention will be described below with reference to the accompanying drawings.

First Embodiment

Figure 1:
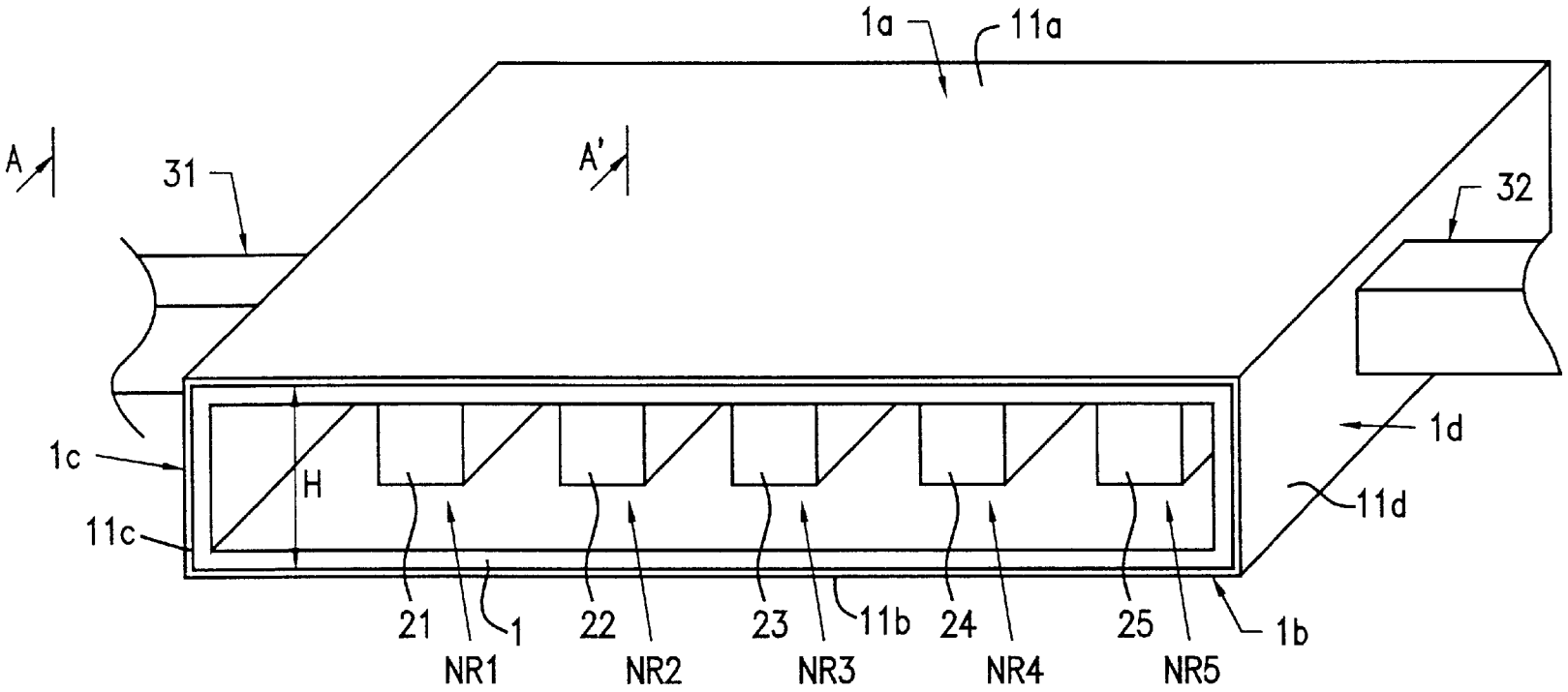
FIG. 1 is a perspective view illustrating the exterior of an integrated NRD waveguide superconducting band-pass filter apparatus according to a first embodiment of the present invention.
Figure 5:
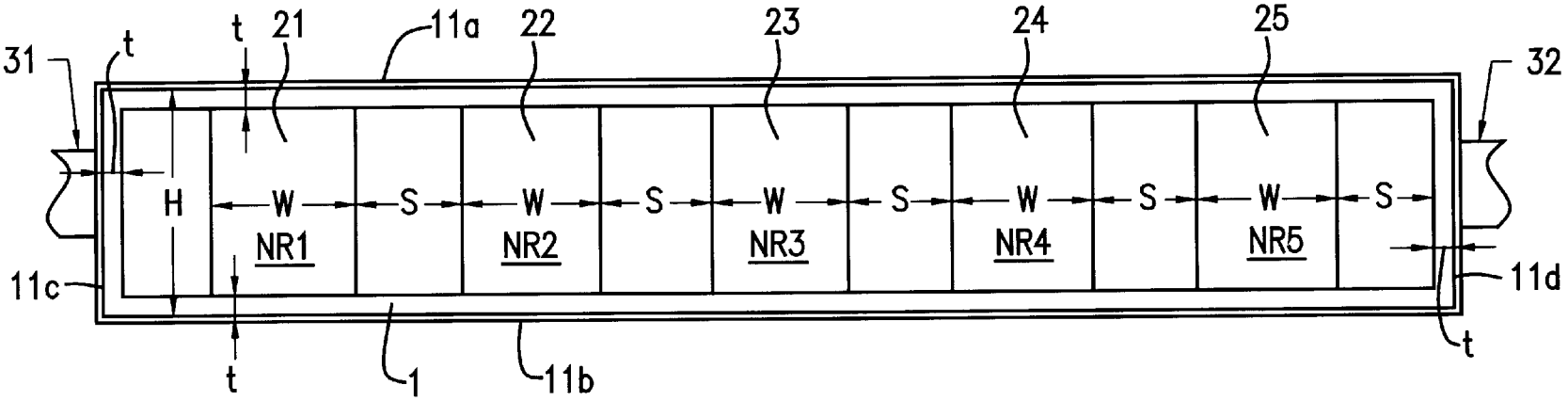
FIG. 5 is a front view of the band-pass filter apparatus shown in FIG. 1.
Figure 6:
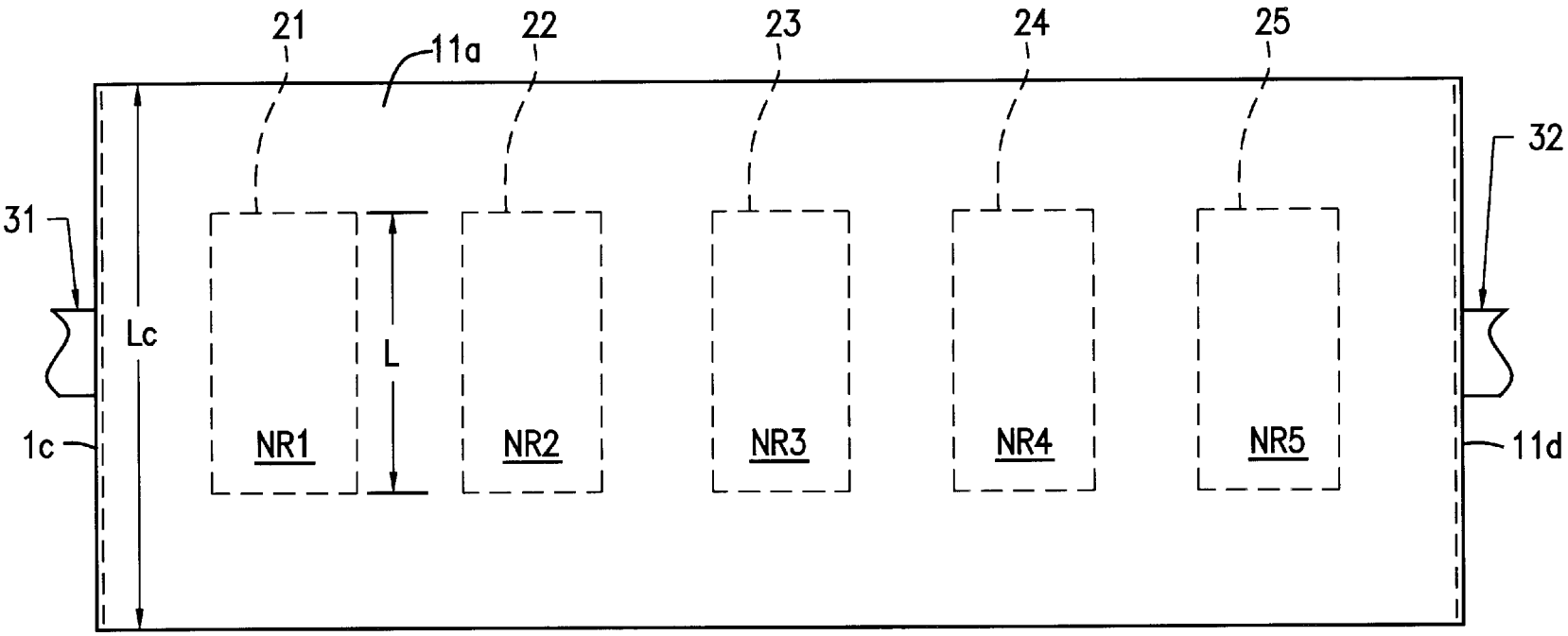
FIG. 6 is a plan view of the band-pass filter apparatus shown in FIG. 1.

FIG. 1 is a perspective view illustrating the exterior of an integrated NRD waveguide superconducting band-pass filter apparatus according to a first embodiment of the present invention. A front view thereof is shown in FIG. 5, and a plan view thereof is shown in FIG. 6. In FIGS. 1, 5 and 6, a dielectric housing 1 made of dielectric materials, such as ceramics having a high dielectric constant, such as $Ba(Sn,Mg,Ta)O_3$ or $(Zr,Sn)TiO_4$, is formed integrally in such a way that dielectric waveguides 21, 22, 23, 24 and 25, each of which has a rectangular-prism shape, are interposingly disposed between an upper surface portion 1*a* and a lower surface portion 1*b*. The dielectric waveguides 21–25 have the shape of flat plates which face each other, with predetermined spaces S between them (the spaces S not being necessarily equal) each according to a predetermined coupling coefficient. The longitudinal end portions of the upper surface portion 1*a* and the lower surface portion 1*b* are respectively connected by two end surface portions 1*c* and 1*d*. Thus, the longitudinal cross-sectional shape of the entire apparatus is rectangular. Here, the dielectric waveguides 21, 22, 23, 24 and 25 are arrayed in such a way that the longitudinal direction thereof is parallel to the direction of the width of the upper surface portion 1*a* and the lower surface portion 1*b*, and both longitudinal ends of each of the dielectric waveguides 21, 22, 23, 24 and 25 are separated by a predetermined distance from respective widthwise edges of both of the upper surface portion 1*a* and the lower surface portion 1*b*.

The dielectric housing 1 can be formed by firing, for example, a machined or injection-molded structure made of $Ba(Sn,Mg,Ta)O_3$.

Flat-plate-shaped superconducting electrodes 11*a* and 11*b*, which are superconducting thick films which have a thickness of, for example, 3 $\mu$m and which are made of superconducting materials such as, for example, YBCO (yttrium barium copper oxide), are formed in close contact by an evaporation method on the outer surfaces of the upper surface portion 1*a* and the lower surface portion 1*b*, respectively. Flat-plate-shaped superconducting electrodes 11*c* and 11*d*, which are superconducting thick films which have the same thickness and materials as those of the superconducting electrodes 11*a* and 11*b*, are formed in close contact on the two end surface portions 1*c* and 1*d*, respectively, by an evaporation method in order to increase the mechanical strength and shield electromagnetic fields. Here, the space H between the superconducting electrodes 11*a* and 11*b* which are the upper and lower plane electrodes is set at a half-wavelength or less of the center frequency in vacuum of the relevant filter apparatus. The superconducting electrodes 11*c* and 11*d* may be made from metallic materials such as Au, Cu or the like.

Figure 8A:
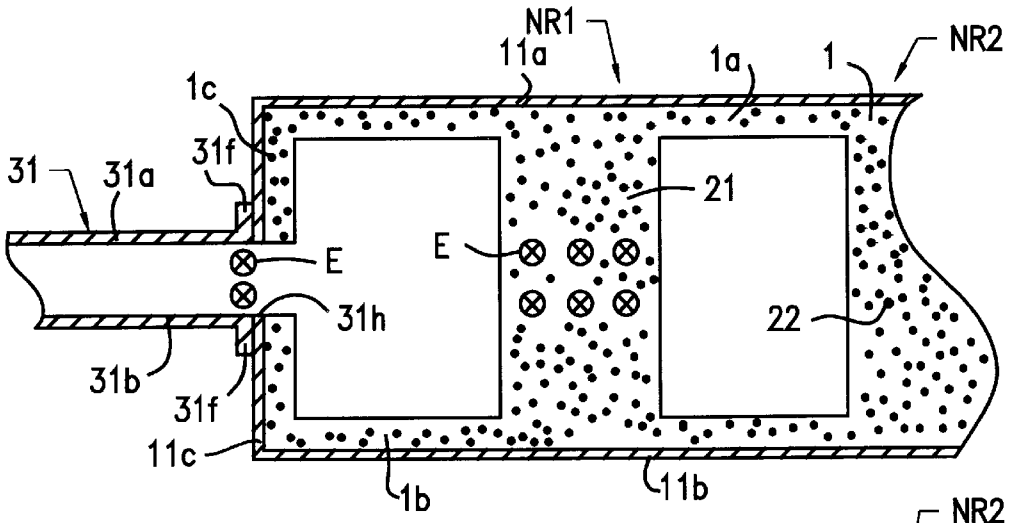
FIG. 8A is a longitudinal sectional view illustrating the electric-field distribution of the band-pass filter apparatus in an LSE mode in accordance with the first embodiment, which view is cut by a plane (A-A' in FIG. 1) parallel to the transmission direction in the rectangular waveguide.
Figure 8B:
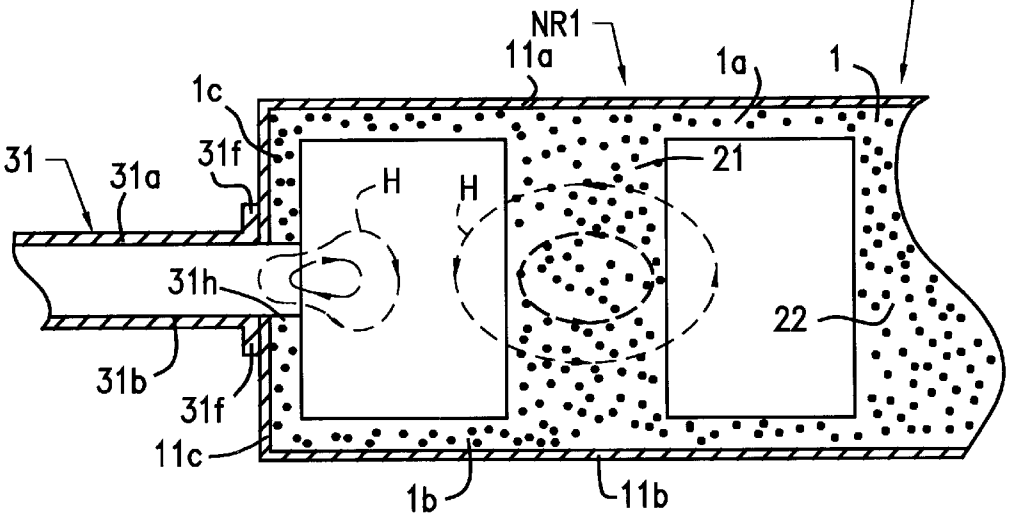
FIG. 8B is a longitudinal sectional view illustrating the magnetic-field distribution of the band-pass filter apparatus in an LSE mode in accordance with the first embodiment, which view is cut by a plane (B-B' in FIG. 2) parallel to the transmission direction in the rectangular waveguide.

As shown in FIGS. 8A and 8B, in the central portion of the end surface portion 1*c*, a rectangular-shaped hole 31*h* is formed in such a manner as to open in the direction of the thickness of the end surface portion 1*c* and the electrode 11*c*. A rectangular waveguide 31 which is formed by an upper surface portion 31*a* and a lower surface portion 31*b* which form an E plane, and two side surface portions which form an H plane, are connected to the hole 31*h* by a flange 31*f*. Likewise, in the central portion of the end surface portion 1*d*, a rectangular-shaped hole (not shown) is formed in such a manner as to open along the direction of the thickness of the end surface portion 1*d* and the electrode 11*d*, (not shown in FIGS. 8A–8B) and a rectangular waveguide 32, (not shown in FIGS. 8A–8B) formed by upper and lower surface portions which form an E plane and two side surface portions which form an H plane, is connected to the hole by a flange.

Figure 7B:
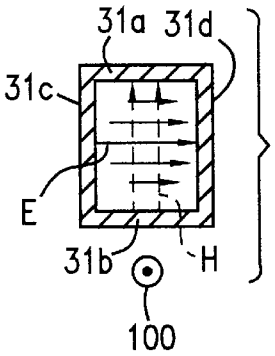
FIG. 7B is a transverse sectional view illustrating the transmission electromagnetic-field distribution of a $TE_{01}$ mode rectangular waveguide in the band-pass filter apparatus in accordance with the first embodiment, which view is cut by a plane vertical to the transmission direction in the rectangular waveguide.
Figure 7A:
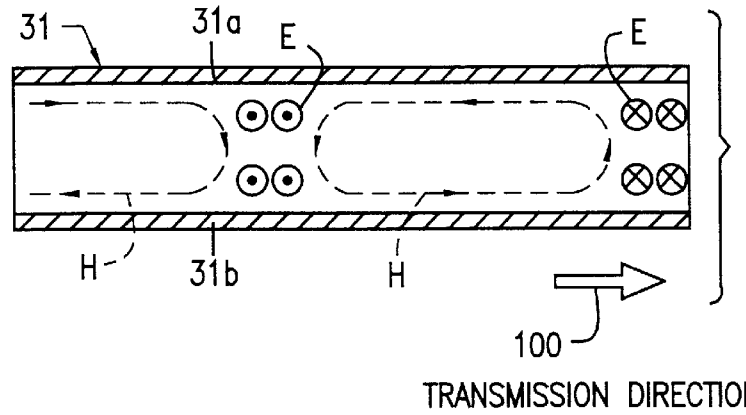
FIG. 7A is a longitudinal sectional view illustrating the transmission electromagnetic-field distribution of a $TE_{01}$ mode rectangular waveguide in the band-pass filter apparatus in accordance with the first embodiment, which view is cut by a plane parallel to the transmission direction in the rectangular waveguide.
Figure 7D:
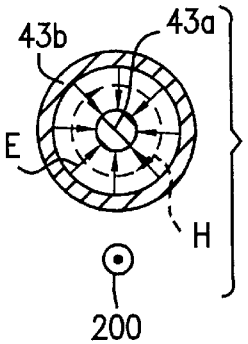
FIG. 7D is a transverse sectional view illustrating the transmission electromagnetic-field distribution of the coaxial waveguide in the band-pass filter apparatus in accordance with the second embodiment, which view is cut by a plane vertical to the transmission direction in the rectangular waveguide.

FIG. 7A shows a transmission electromagnetic-field of a rectangular waveguide having a $TE_{01}$ mode. In this embodiment, an $LSE_{01}$ mode resonator is coupled to the $TE_{01}$ mode rectangular resonator, as shown in FIGS. 8A and 8B. This is because the electromagnetic-field vector when the $LSE_{01}$ mode resonator is seen from the end surface thereof coincides satisfactorily with the electromagnetic-field within the cross-section in the $TE_{01}$ mode. More specifically, the horizontal components of the electric-field vector intersect at right angles to the vertical components of the magnetic-field vector, and the vertical components of the electric-field vector intersect at right angles to the horizontal components of the magnetic-field vector. The direction of the electric-field of the rectangular waveguide coincides with the direction of the electric-field of the resonator, whereas the direction of the magnetic-field of the rectangular waveguide coincides with the direction of the magnetic-field of the resonator.

In the band-pass filter apparatus of the first embodiment of the invention, described above in connection with FIGS. 1, 5, 6, 7A, 7B, 8A and 8B, NRD waveguide resonators NR1 to NR5 having an $LSE_{01}$ mode and a predetermined resonance frequency are formed by the dielectric waveguides 21, 22, 23, 24 and 25 interposed between the superconducting electrodes 11*a* and 11*b*, and the NRD waveguide resonators NR1 to NR5 are formed as band-pass filters each having a predetermined pass band. Here, each two adjacent resonators are electromagnetically coupled, the rectangular waveguide 31 is electromagnetically coupled to the resonator NR1 at the initial stage, and the resonator NR5 at the final stage is electromagnetically coupled to the rectangular waveguide 32. As a result, a band-pass filter apparatus comprising cascaded band-pass filters at five stages is disposed between the rectangular waveguide 31 which is an input transmission waveguide and the rectangular waveguide 32 which is an output transmission waveguide.

The upper surface portion 1*a* and the lower surface portion 1*b* of the dielectric housing 1 have the function only of supporting the superconducting electrodes 11*a* and 11*b* formed on the outer surfaces thereof and do not have the function of forming an NRD waveguide superconducting band-pass filter apparatus. Therefore, the thicknesses t of the upper surface portion 1*a* and the lower surface portion 1*b* are formed so as to be sufficiently thin in comparison with the space H between the superconducting electrodes 11*a* and 11*b* which are the upper and lower plane electrodes, in order to prevent a phenomenon in which there is interference with the resonance mode of the NRD resonators which constitute each NRD waveguide band-pass filter, and the no-load Q deteriorates.

Since the main purpose of the two end surface portions 1*c* and 1*d* is to support the superconducting electrodes 11*c* and 11*d* (or metallic electrodes) for shielding an electromagnetic field, their thickness is formed sufficiently thin within the range in which the $TE_{01}$ mode mechanical strength is maintained. In this embodiment, the rectangular waveguide (for example the waveguide 31) is formed so as to be coupled to the side of the $LSE_{01}$ mode resonator, as shown in FIGS. 8A and 8B.

In this embodiment, since the superconducting electrodes 11*a*, 11*b*, 11*c* and 11*d* are used, the ambient temperature of the present apparatus is cooled to a low temperature of, for example, 77° K by using nitrogen gas or the like so that the superconducting electrodes 11*a*, 11*b*, 11*c* and 11*d* are operated with a low loss.

Next, a method of setting each parameter in the filter apparatus of this embodiment will be described with reference to the accompanying drawings.

Figure 21:
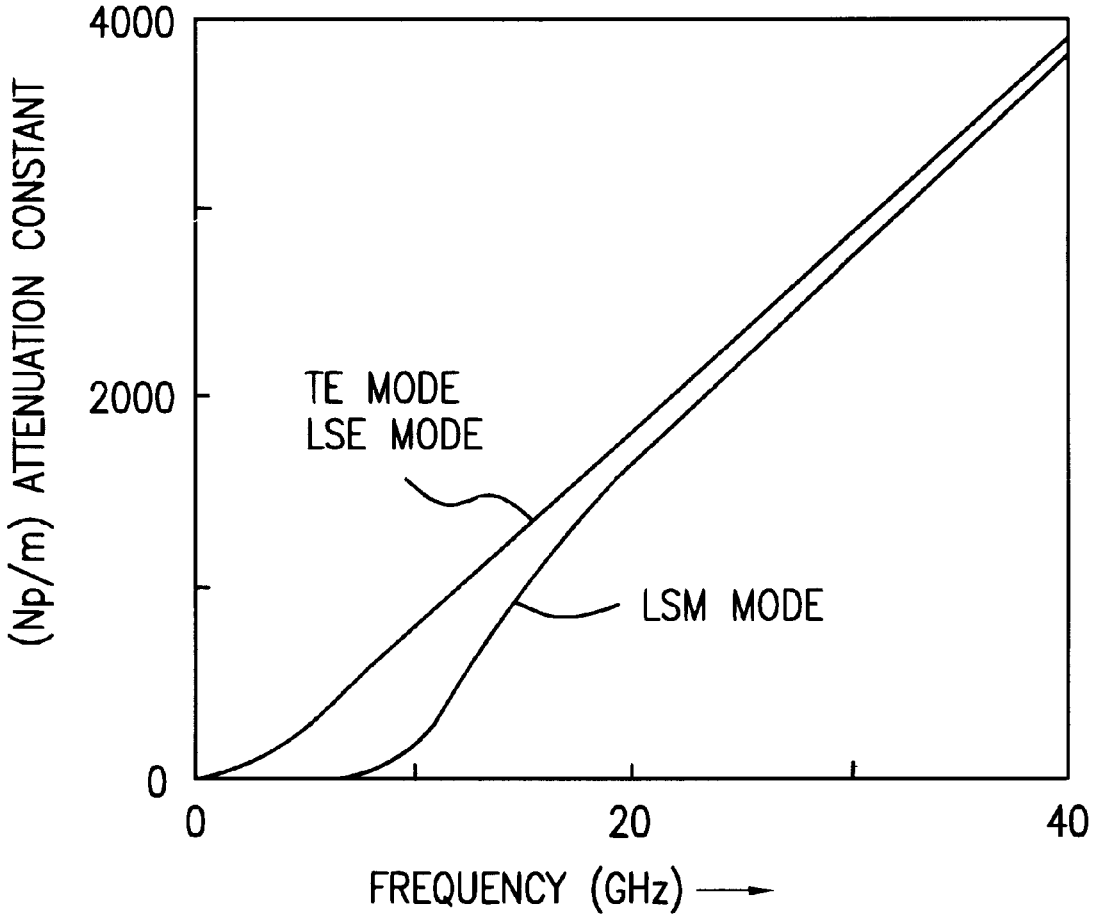
FIG. 21 is a graph illustrating the frequency characteristics of the attenuation constant of electromagnetic waves when the right-to-left width direction intersecting at right angles to the transmission direction of the dielectric waveguide is observed in the LSE mode, the LSM mode and the TE mode.

FIG. 21 is a graph illustrating the frequency characteristics of the attenuation constant of electromagnetic waves when the right-to-left width direction of the dielectric waveguide intersecting at right angles to the transmission direction thereof is seen in the LSE mode, the LSM mode and the TE mode. The calculation conditions for simulation in FIG. 21 are set as follows: a space H of 5.0 mm between the pair of superconducting electrodes 11*a* and 11*b*, a width W of 2.5 mm, and a specific inductive capacity $\epsilon r$ of 24.

Figure 22:
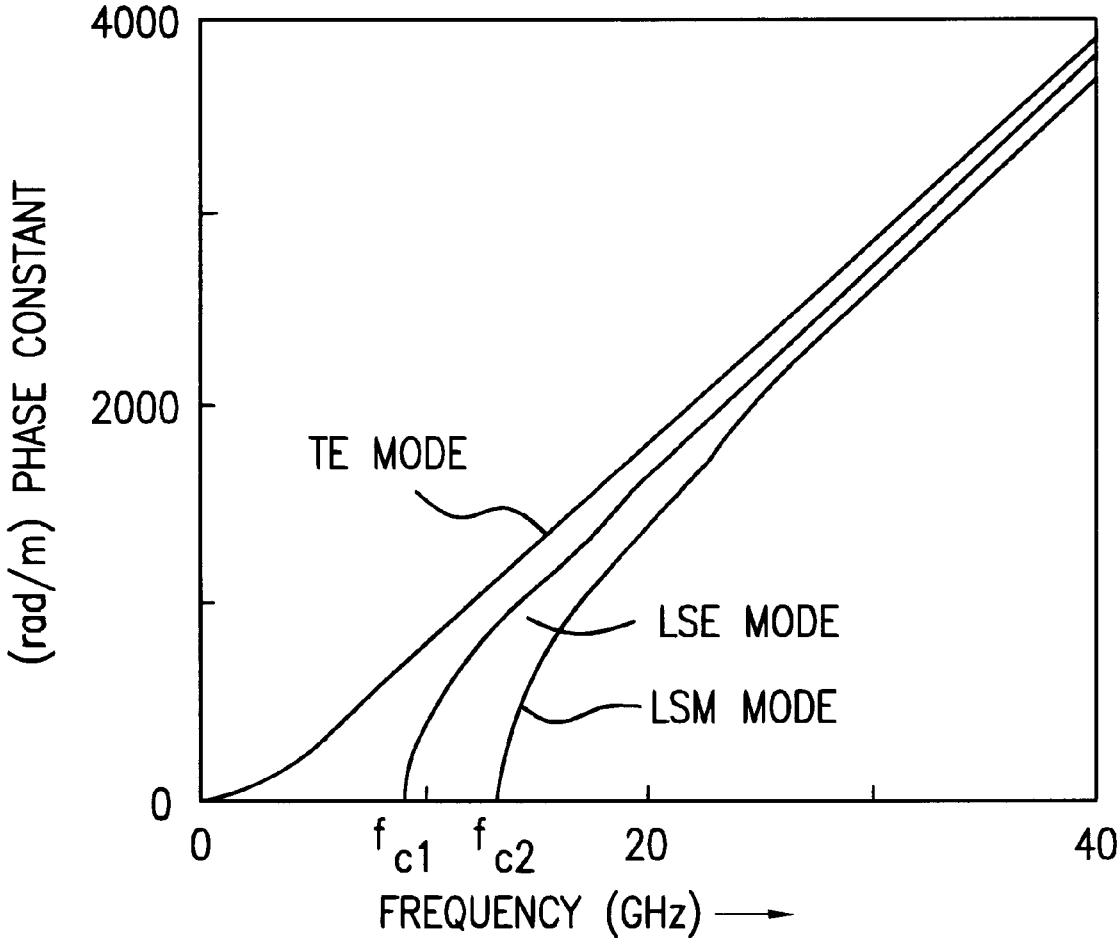
FIG. 22 is a graph illustrating the frequency characteristics of the phase constant in the LSE mode, the LSM mode and the TE mode.

FIG. 22 is a graph illustrating the frequency characteristics of the phase constant in the LSE mode, the LSM mode and the TE mode. The calculation conditions for simulation in FIG. 22 are set as follows: a space H of 5.0 mm between the pair of superconducting electrodes 11*a* and 11*b*, a width W of 2.5 mm, and a specific inductive capacity $\epsilon r$ of 24.

Figure 23:
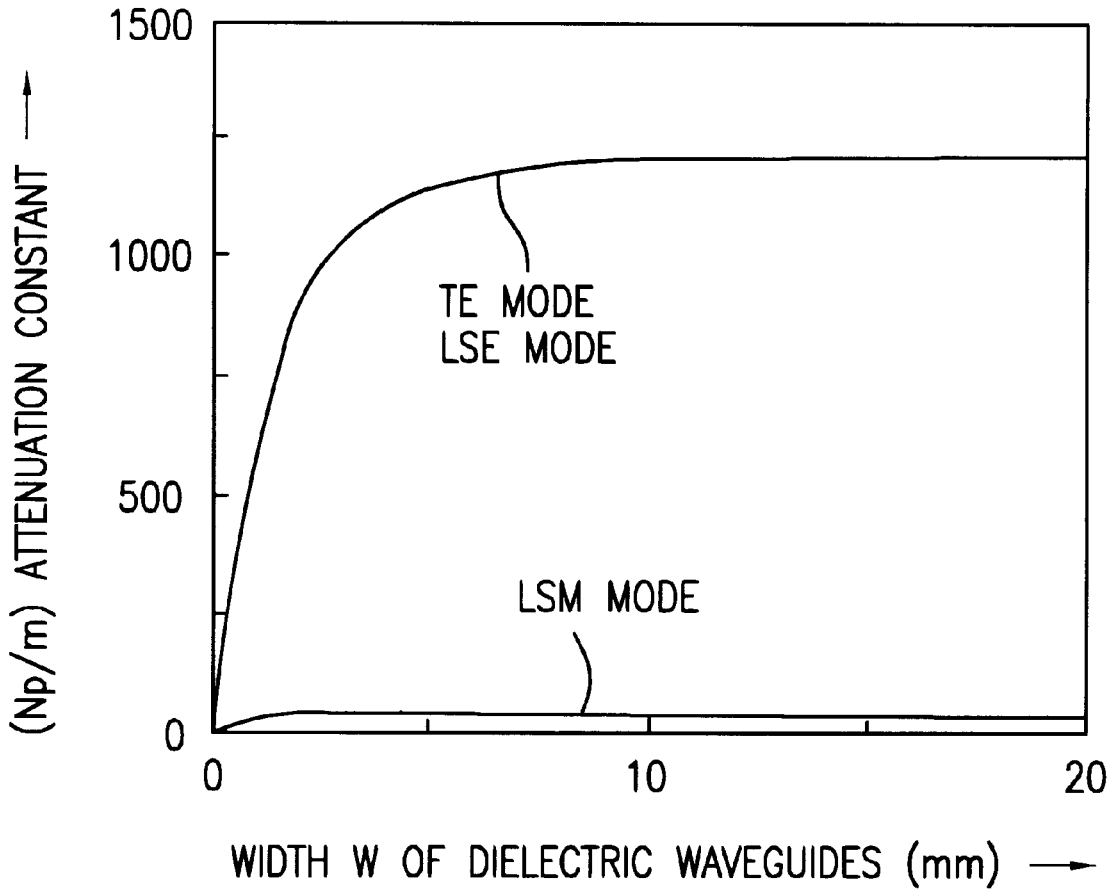
FIG. 23 is a graph illustrating the line width characteristics of the attenuation constant of electromagnetic waves when the right-to-left width direction intersecting at right angles to the transmission direction of the dielectric waveguide is observed in the LSE mode, the LSM mode and the TE mode.

FIG. 23 is a graph illustrating the waveguide width characteristics of the attenuation constant of electromagnetic waves when the right-to-left width direction intersecting at right angles to the transmission direction of the dielectric waveguide is observed in the LSE mode, the LSM mode and the TE mode. The calculation conditions for simulation in FIG. 23 are set as follows: a space H of 5.0 mm between the pair of superconducting electrodes 11*a* and 11*b*, a frequency $f_0$ of 12 GHz, and a specific inductive capacity $\epsilon r$ of 24.

Figure 24:
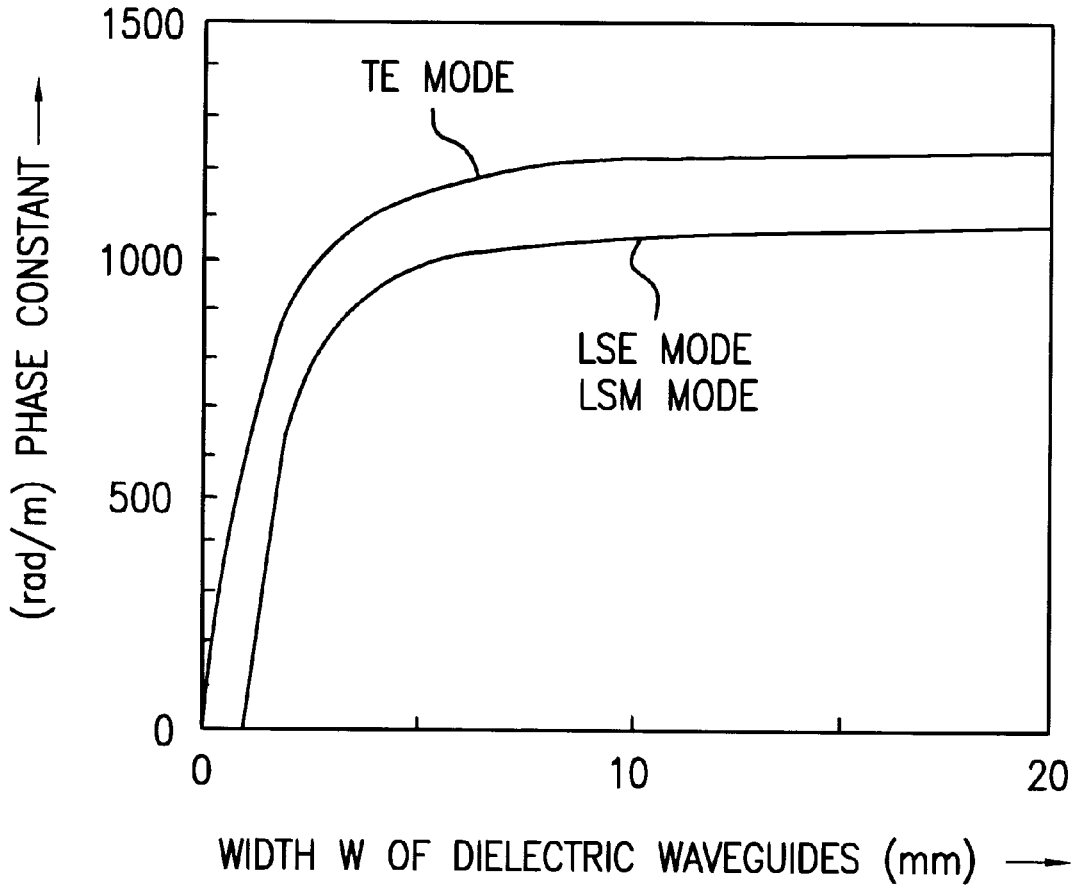
FIG. 24 is a graph illustrating the line width characteristics of the phase constant in the LSE mode, the LSM mode and the TE mode.

FIG. 24 is a graph illustrating the waveguide width characteristics of the phase constant in the LSE mode, the LSM mode and the TE mode. The calculation conditions for simulation in FIG. 24 are set as follows: a space H of 5.0 mm between the pair of superconducting electrodes 11*a* and 11*b*, a frequency $f_0$ of 12 GHz, and a specific inductive capacity $\epsilon r$ of 24.

Figure 25:
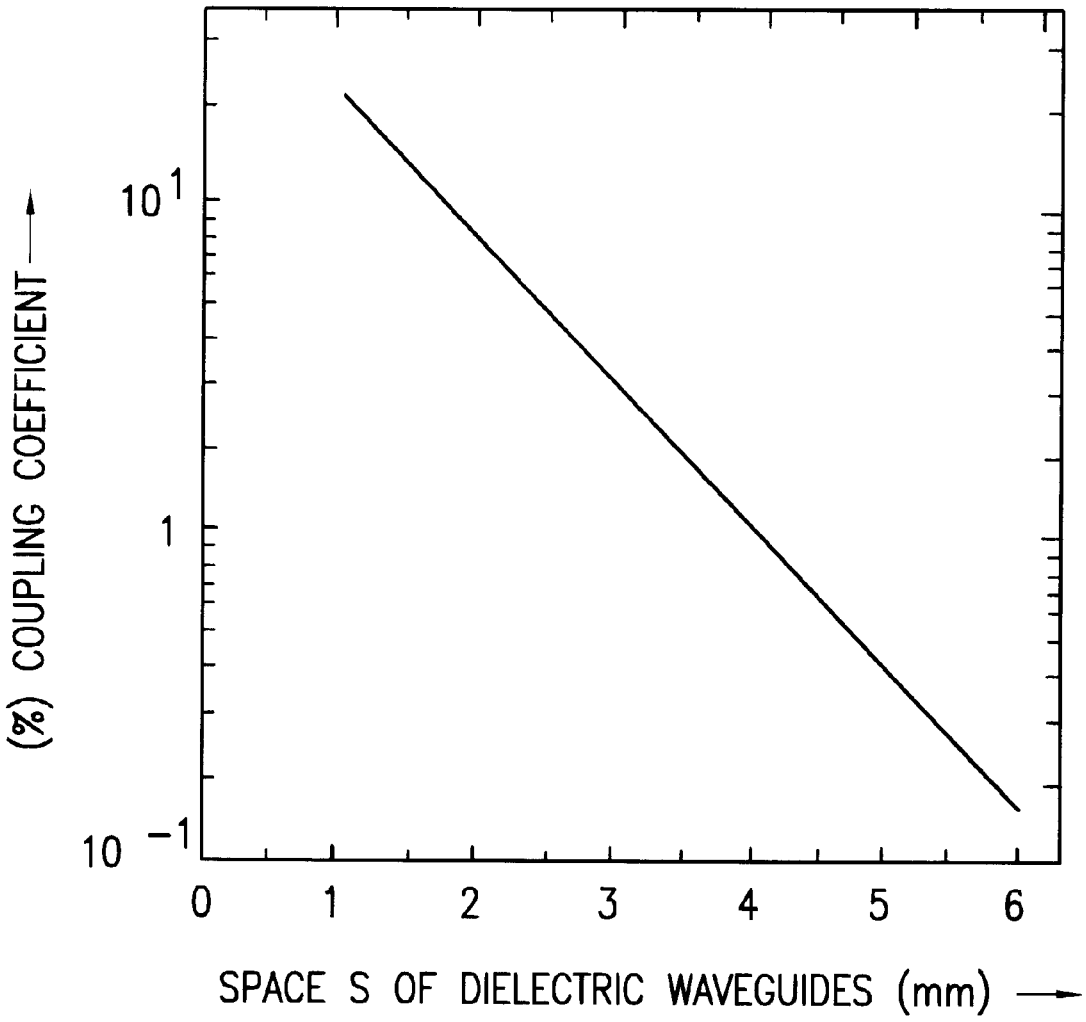
FIG. 25 is a graph illustrating the characteristics of the coupling coefficient with respect to space S between two arrayed dielectric waveguides.

FIG. 25 is a graph illustrating the characteristics of the coupling coefficient with respect to the space S between two arrayed dielectric waveguides. The calculation conditions for simulation in FIG. 25 are set as follows: a space H of 5.0 mm between the pair of superconducting electrodes 11*a* and 11*b*, a width W of 2.5 mm, and a specific inductive capacity $\epsilon r$ of 24.

(1) Space H Between the Superconducting Electrodes 11*a* and 11*b*

The space H is set to one-half the resonance wavelength or less in a vacuum of the present filter apparatus. By setting the space H to such limitation conditions, it is possible to set the space S between the dielectric waveguides, i.e., the portions between each pair of dielectric waveguides 21 to 25, to be a cut-off region.

(2) Width W of the Dielectric Waveguides 21 to 25

The width W of the dielectric waveguides 21 to 25 determines the attenuation constant of waves when seen from the right-to-left width direction intersecting at right angles to the transmission direction. For example, in a case of a waveguide having a space H of 5.0 mm using a dielectric material having a specific dielectric constant $\epsilon r$ of 24, when the frequency is 12 GHz, the attenuation constants are as shown in FIG. 23, and by increasing the width W of the waveguide, it is possible to sharpen the attenuation in the width direction. Also, as shown in FIG. 21, the higher the frequency, the greater the attenuation constant of each mode. Furthermore, as shown in FIG. 24, the phase constant of each mode reaches a saturated state when the width W of the dielectric waveguide increases to a certain degree.

(3) Lengths L of the Dielectric Waveguides 21 to 25

The lengths L of the dielectric waveguides 21 to 25 are determined on the basis of resonance frequencies to be set in each of the resonators NR1 to NR5. The resonance frequencies are determined so that the dielectric waveguides 21 to 25 resonate at substantially a half-wavelength or an integral multiple of a half-wavelength, including attenuated waves, in the front-to-back direction when seen from the end surface, with respect to the length L of the dielectric waveguides 21 to 25.

(4) Space S Between Each Pair of Dielectric Waveguides 21 to 25

The space S between each pair of dielectric waveguides 21 to 25 determines the coupling coefficient between two adjacent resonators. As shown in FIG. 25, the narrower the space S of the waveguides and the smaller the attenuation constant in the cut-off region, the greater the coupling coefficient. The graph in FIG. 25 shows the coupling coefficient K, with the waveguide space S as a variable, in a case where the NRD waveguide resonators NR1 to NR5 are formed using materials of a specific dielectric constant $\epsilon r$ of 24 with a space H of 5.0 mm and a waveguide width W of 2.5 mm. As is clear from FIG. 25, when the waveguide space S is set at 5.0 mm, the coupling coefficient K becomes approximately 0.4%.

(5) Thickness t of Each of the Sections 11*a*, 11*b*, 11*c* and 11*d* of the Dielectric Housing 1, Formed Using Dielectric Materials The thickness t is set so as to maintain the mechanical strength required to perform the above-described functions. When the thickness t is thick to a certain degree in comparison with the space H, there is a tendency for the sharpness of the attenuation constant in the cut-off region to decrease, and the coupling coefficient K to increase.

The frequency characteristics (i.e., the divergence relation) of the phase constants of the NRD waveguide resonators constructed as described above are as shown in FIG. 22. As is clear from FIG. 22, a $TE_{10}$ mode (basic mode), a secondary $LSE_{01}$ mode, and a tertiary $LSM_{01}$ mode occur in this order starting from the low frequency side. The $LSE_{01}$ mode and the $LSM_{01}$ mode have cut-off frequencies $f_{c1}$ and $f_{c2}$, respectively; however, in the $TE_{10}$ mode, propagation is based on a direct current. Therefore, in the first embodiment, when, for example, a resonator having an $LSE_{01}$ mode is formed, a resonator having an $LSE_{01}$ mode as a main mode can be formed by setting the center frequency of the present filter preferably between the cut-off frequency $f_{c1}$ and the cut-off frequency $f_{c2}$ and by adjusting each of the above-described parameters so as to suppress spurious modes other than the $LSE_{01}$ mode. Also, in the second embodiment, when, for example, a resonator having an $LSM_{01}$ mode is formed, a resonator having an $LSM_{01}$ mode as a main mode can be formed by setting the center frequency of the present filter apparatus to the cut-off frequency $f_{c2}$ or higher and by adjusting each of the above-described parameters so as to suppress spurious modes other than the $LSM_{01}$ mode.

Next, the electric-field distribution, magnetic-field distribution, and electric-current distribution in the transmission mode of each transmission waveguide are shown in FIGS. 10A, 10B and 10C, FIGS. 12A, 12B, and 12C, and FIGS. 14A, 14B, and 14C, respectively. A description will be given below of the electric-field, magnetic-field, and electric-current distributions in the transmission mode of each transmission waveguide.

(A1) Transmission Waveguide (FIGS. 10A, 10B and 10C) in the $LSE_{01}$ Mode In the $LSE_{01}$ mode, an electric-field vector E is present only within the plane parallel to the propagation direction and vertical to the superconducting electrodes 11*a* and 11*b* which are the upper and lower electrodes. Electric currents I are generated in the central portion of the electrodes 11*a* and 11*b* which correspond to the upper and lower surfaces of a dielectric waveguide 26 in such a manner as to be parallel to the propagation direction and with the directions being aligned. Further, at a position deviated by a half-wavelength, the front-to-back directions of the electric currents I interchange. The superconducting electrodes 11*c* and 11*d* on the side are provided for the purpose of shielding electromagnetic fields, and transmission electric currents I do not substantially flow through these electrodes 11*c* and 11*d*.

(A2) Transmission Waveguide (FIGS. 12A, 12B and 12C) in the $LSM_{01}$ Mode In the $LSM_{01}$ mode, a magnetic-field vector H is present only within the plane parallel to the propagation direction and vertical to the superconducting electrodes 11*a* and 11*b* which are the upper and lower electrodes. Electric currents I are generated in the central portion of the electrodes 11*a* and 11*b* on the upper and lower surfaces of a dielectric waveguide 27 in such a manner as to be parallel to the propagation direction and with the directions being aligned. Further, at a position deviated by a half-wavelength, the right-to-left directions of the electric currents I interchange. The superconducting electrodes 11*c* and 11*d* on the sides are provided for the purpose of shielding electromagnetic fields, and substantial transmission electric currents I do not flow through these electrodes 11*c* and 11*d*.

(A3) Transmission Waveguide (FIGS. 14A, 14B and 14C) in the $TE_{10}$ Mode In the $TE_{10}$ mode, an electric-field vector E is present only within the plane vertical to the propagation direction. An electric current I flows radially from the central portion (of a waveguide 28) of a superconducting electrode 11*a* on the upper surface, and flows through the superconducting electrodes 11*c* and 11*d* on the side toward the central portion of the electrode 11*b* on the lower surface. Further, at a position deviated by a half-wavelength, the directions of the electric currents I of the superconducting electrodes 11*a* and 11*b* on the upper and lower surfaces interchange. Therefore, the electrodes 11*c* and 11*d* on the sides play an essentially necessary role in causing transmission electric current I to flow.

Next, FIGS. 11A, 11B, and 11C, FIGS. 13A, 13B, and 13C and FIGS. 15A, 15B, and 15C show respectively the electric-field distribution, the magnetic-field distribution, and the electric-current distribution in the resonance mode of each half-wave-length resonator in which dielectric waveguides for each transmission mode are cut to a finite length and the front-to-back region becomes a cut-off region. However, the $LSE_{01}$ mode used in the first embodiment (and the $LSM_{01}$ mode used in the second embodiment) resonate at a half-wavelength under an open condition, and the $TE_{10}$ mode resonates at a half-wavelength under a short-circuit condition. Generally, such a resonator structure is called a $TM_{11}$ mode by regarding the height direction to be the transmission direction.

Figure 11A:
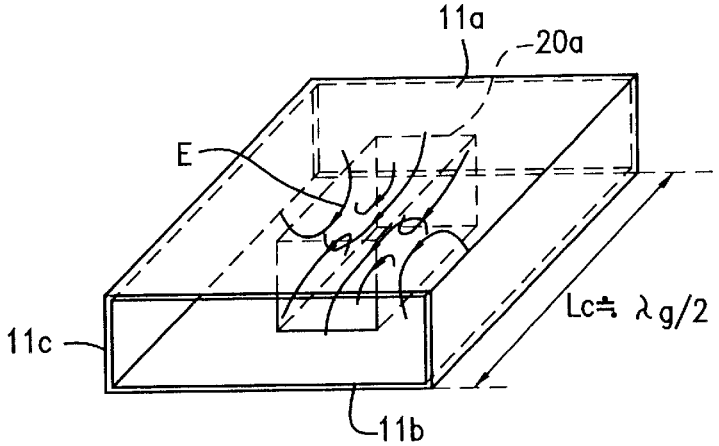
FIG. 11A is a perspective view illustrating the electric-field distribution of an $LSE_{01}$ mode resonator used in the first embodiment.
Figure 11B:
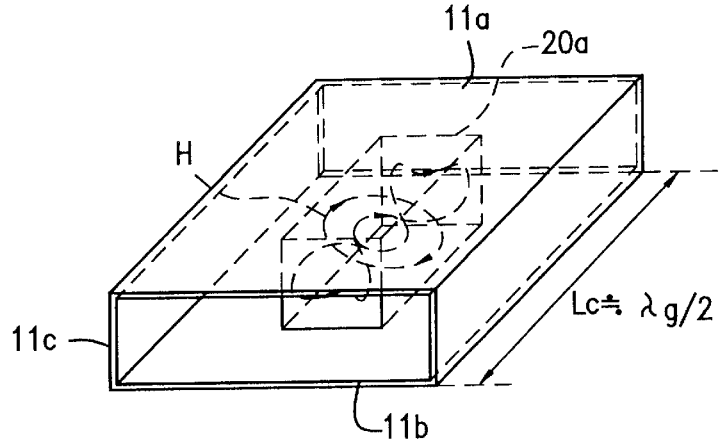
FIG. 11B is a perspective view illustrating the magnetic-field distribution of the $LSE_{01}$ mode resonator.
Figure 11C:
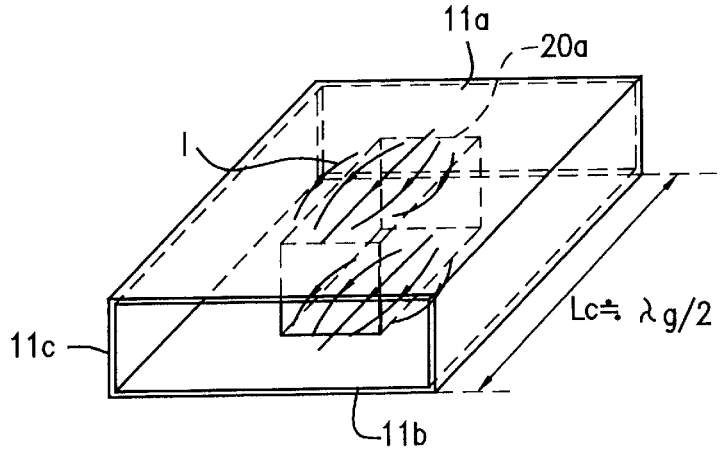
FIG. 11C is a perspective view illustrating the electric-current distribution of the $LSE_{01}$ mode resonator.
Figure 12A:
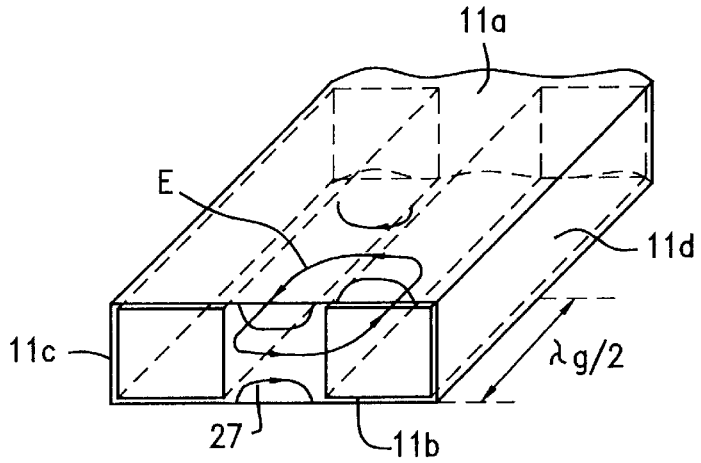
FIG. 12A is a perspective view illustrating the electric-field distribution of an $LSM_{01}$ mode transmission waveguide.
Figure 12B:
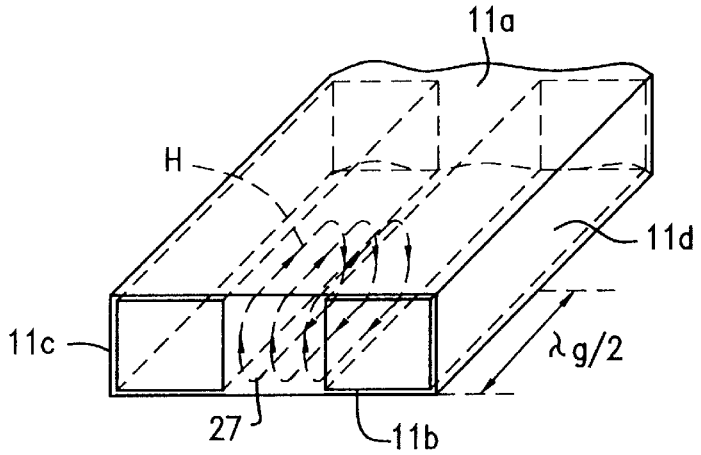
FIG. 12B is a perspective view illustrating the magnetic-field distribution of the $LSM_{01}$ mode transmission waveguide.
Figure 12C:
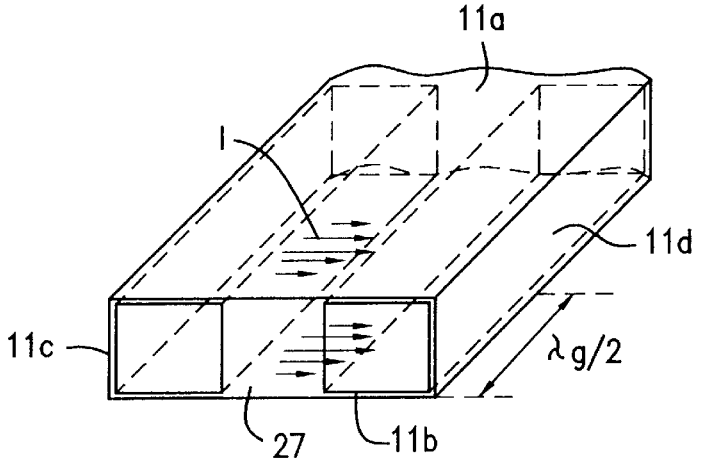
FIG. 12C is a perspective view illustrating the electric-current distribution of the $LSM_{01}$ mode transmission waveguide.

(B1) $LSE_{01}$ Mode Resonator (FIGS. 11A, 11B and 11C)

In the $LSE_{01}$ mode used in the first embodiment, electromagnetic-field energy concentrates within a dielectric waveguide 20*a*, and the outer portion around the dielectric waveguide 20*a* is a cut-off region; therefore energy confinement characteristics are excellent. Electric currents I are generated centered in the central portion (of each waveguide) of the superconducting electrodes 11*a* and 11*b* which are the upper- and lower-surface electrodes of the dielectric waveguide 20*a*. The electric currents I of the superconducting electrodes 11*a* and 11*b* on the upper and lower surfaces flow in the same direction with plane symmetry and do not intersect each other. The electrodes 11*c* and 11*d* on the sides are provided for shielding electromagnetic fields, and substantial transmission electric currents I do not flow through the electrodes 11*c* and 11*d* on the sides.

Figure 13A:
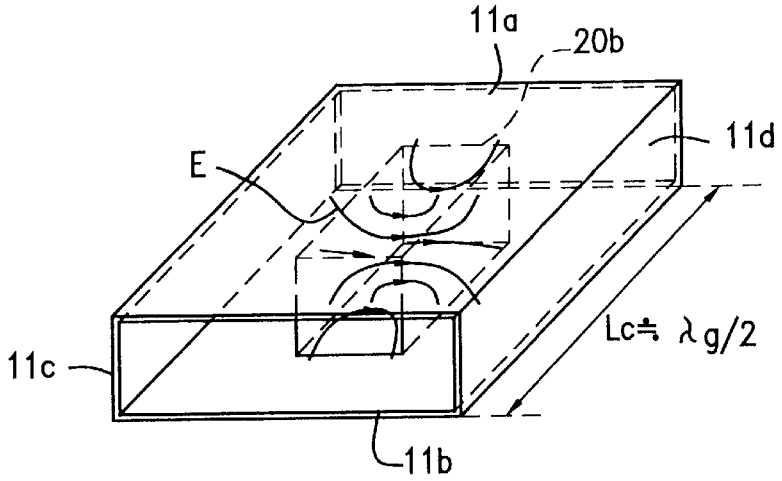
FIG. 13A is a perspective view illustrating the electric-field distribution of an $LSM_{01}$ mode resonator used in the second embodiment.
Figure 13B:
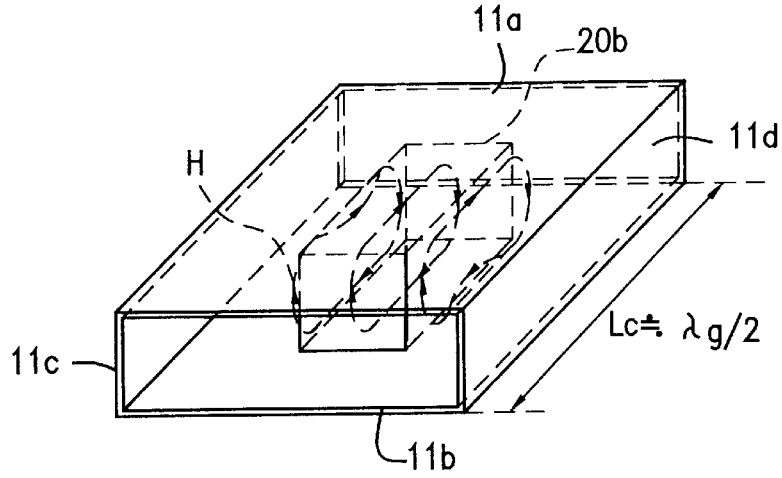
FIG. 13B is a perspective view illustrating the magnetic-field distribution of the $LSM_{01}$ mode resonator.
Figure 13C:
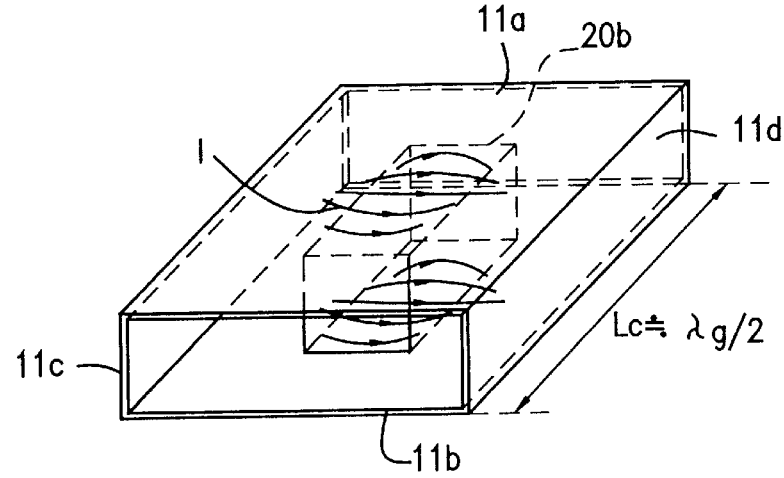
FIG. 13C is a perspective view illustrating the electric-current distribution of the $LSM_{01}$ mode resonator.
Figure 14A:
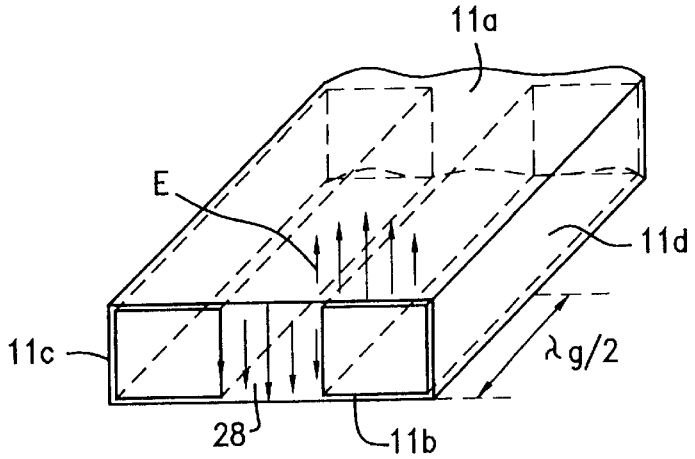
FIG. 14A is a perspective view illustrating the electric-field distribution of a $TE_{10}$ mode transmission waveguide.
Figure 14B:
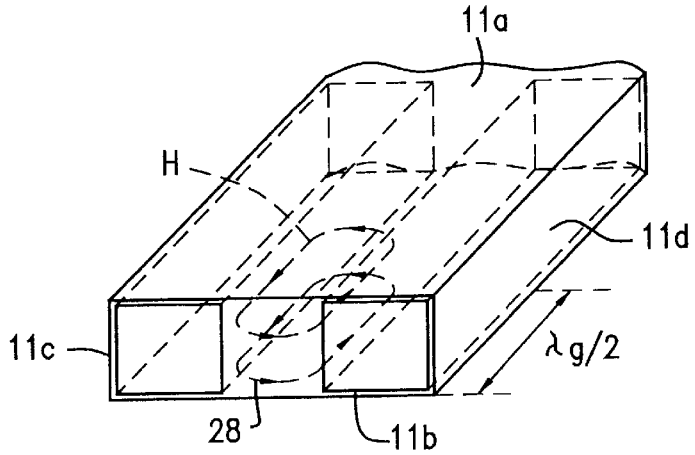
FIG. 14B is a perspective view illustrating the magnetic-field distribution of the $TE_{10}$ mode transmission waveguide.
Figure 14C:
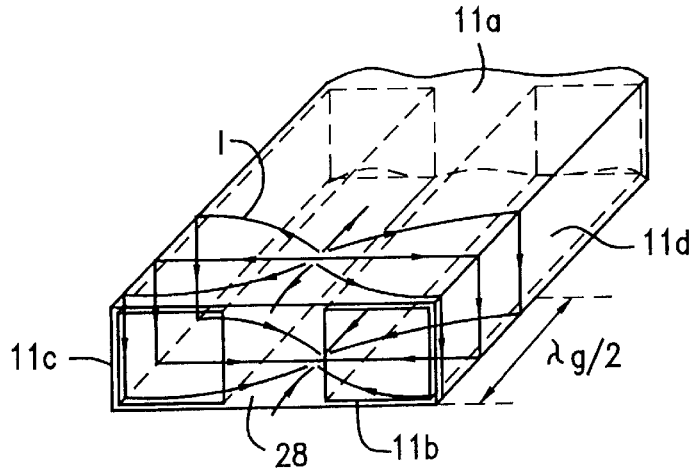
FIG. 14C is a perspective view illustrating the electric-current distribution of the $TE_{10}$ mode transmission waveguide.

(B2) $LSM_{01}$ Mode Resonator (FIGS. 13A, 13B and 13C)

The $LSM_{01}$ mode used in the second embodiment is of a higher-order mode than $LSE_{10}$, and the resonator operates in the same way as the $LSE_{01}$ mode resonator at frequencies higher than the cut-off frequency. More specifically, electromagnetic-field energy concentrates within a dielectric waveguide 20*b*, and the outer portion around the dielectric waveguide 20*b* is a cut-off region; therefore, energy confinement characteristics are excellent. Electric currents I are generated centered in the central portion of the superconducting electrodes 11*a* and 11*b* which are the upper- and lower-surface electrodes of the dielectric waveguide 20*b*. The electric currents I of the superconducting electrodes 11*a* and 11*b* which are the upper- and lower-surface electrodes flow in the same direction with plane symmetry and do not intersect each other. The electrodes 11*c* and 11*d* on the side are provided for shielding electromagnetic fields, and substantial transmission electric currents I do not flow through the electrodes 11*c* and 11*d* on the sides.

Figure 15A:
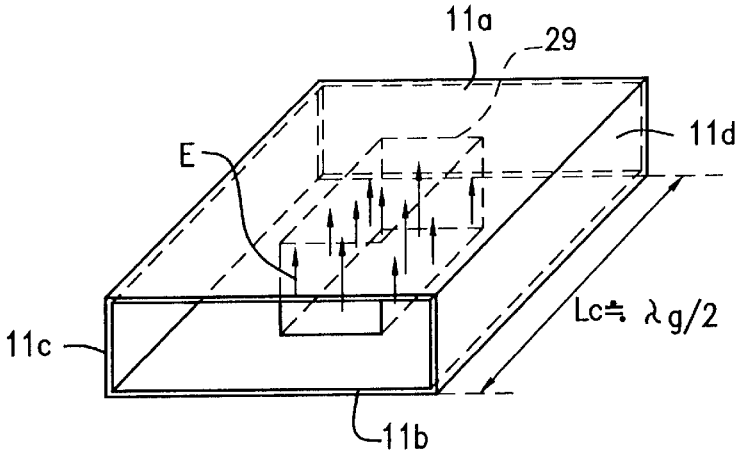
FIG. 15A is a perspective view illustrating the electric-field distribution of a $TM_{11}$ mode transmission waveguide.
Figure 15B:
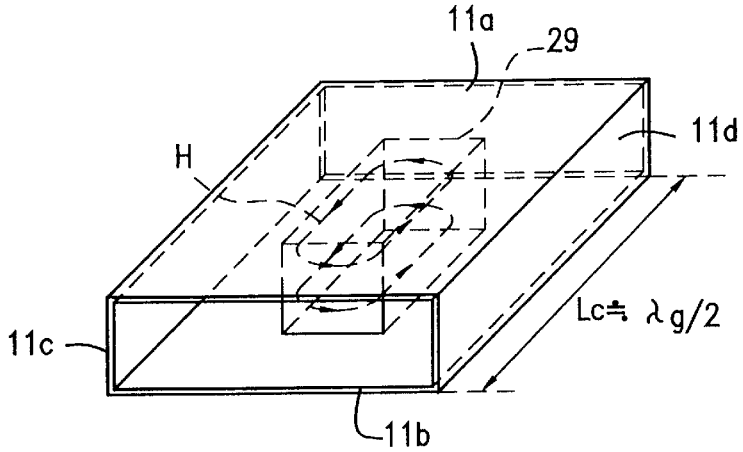
FIG. 15B is a perspective view illustrating the magnetic-field distribution of the $TM_{11}$ mode transmission waveguide.
Figure 15C:
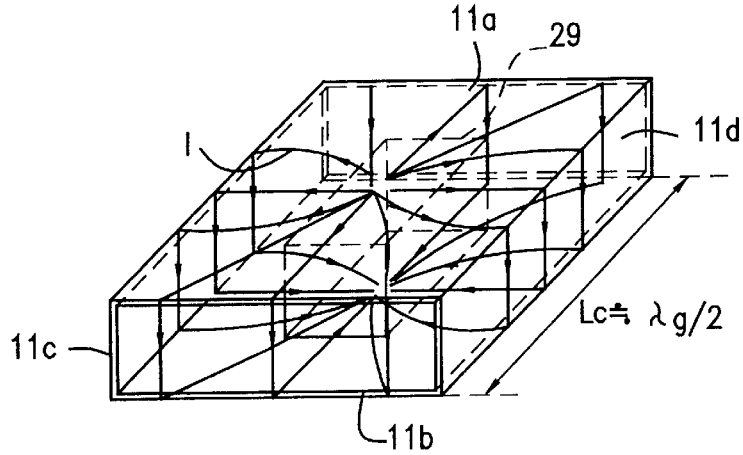
FIG. 15C is a perspective view illustrating the electric-current distribution of the $TM_{11}$ mode transmission waveguide.

(B3) $TM_{11}$ Mode Resonator (FIGS. 15A, 15B and 15C)

In the $TM_{11}$ mode, a concentrated electric-field vector E is parallel to the height direction of the dielectric waveguide 28. An electric current I flows radially from the central portion of the electrode 11*a* of the upper surface, and flows through the electrodes 11*c* and 11*d* on the sides toward the central portion of the electrode 11*b* on the lower surface. Further, at a position out of a half cycle, the directions of the electric currents I interchange. Therefore, the electrodes 11*a* and 11*b* on the side play an essentially necessary role for causing electric current I to flow.

In the first embodiment, a band-pass filter apparatus is formed by using the above-described $LSE_{01}$ mode resonator, whereas in the second embodiment, a band-pass filter apparatus is formed by using the above-described $LSM_{01}$ mode resonator. Concerning the mode notation convention for the LSE and LSM modes in the present specification, the first subscript indicates the number of nodes in the width direction, and the second subscript indicates the number of nodes in the height direction.

Second Embodiment

Figure 2:
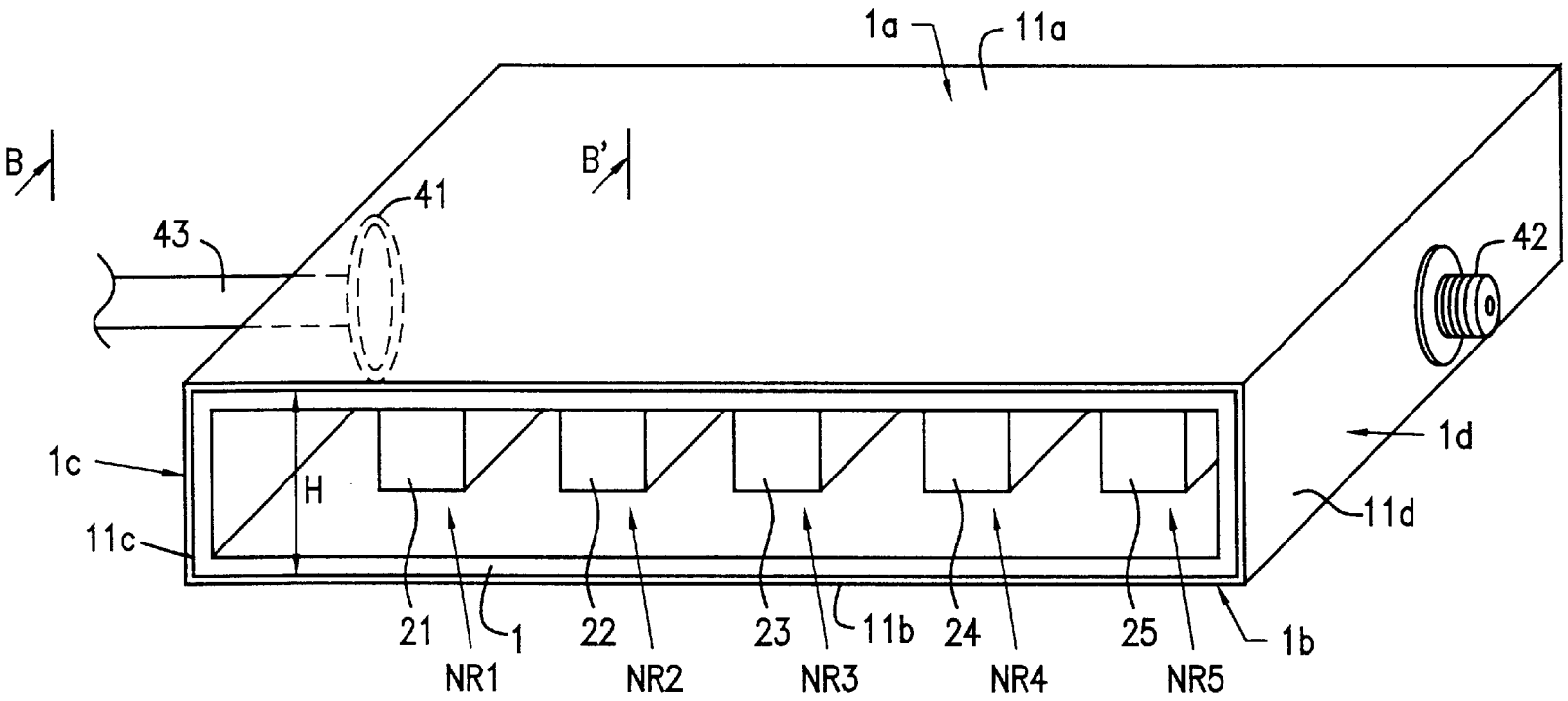
FIG. 2 is a perspective view illustrating the exterior of an integrated NRD waveguide superconducting band-pass filter apparatus according to a second embodiment of the present invention.

FIG. 2 is a perspective view illustrating the exterior of an integrated NRD waveguide superconducting band-pass filter apparatus according to a second embodiment of the present invention. The differences between the second embodiment and the first embodiment are that coaxial connectors 41 and 42 are provided as input/output terminals, and a coaxial waveguide 43 is used as a transmission waveguide. These different points will be described below.

Figure 9A:
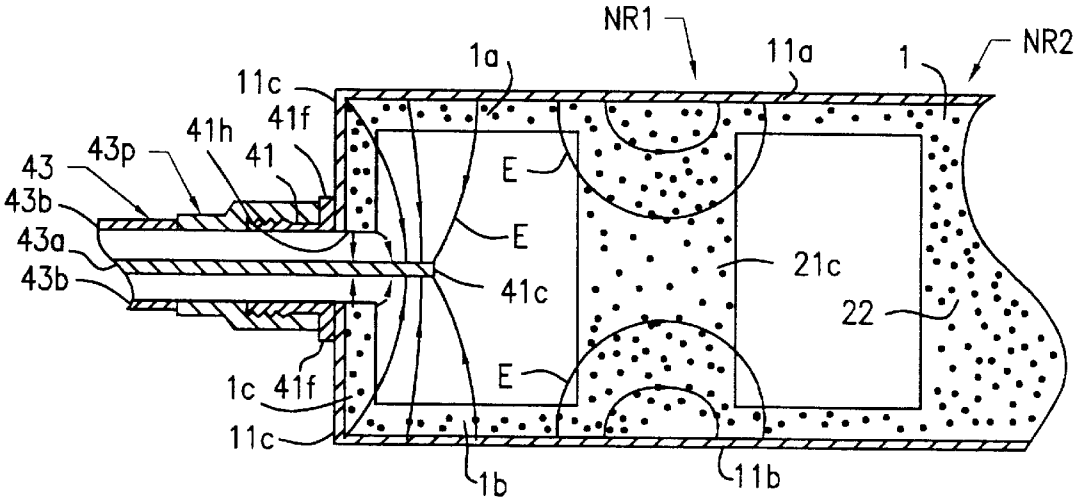
FIG. 9A is a longitudinal sectional view illustrating the electric-field distribution of the band-pass filter apparatus in an LSM mode in accordance with the second embodiment, which view is cut by a plane passing the axis parallel to the transmission direction in a coaxial waveguide.
Figure 9B:
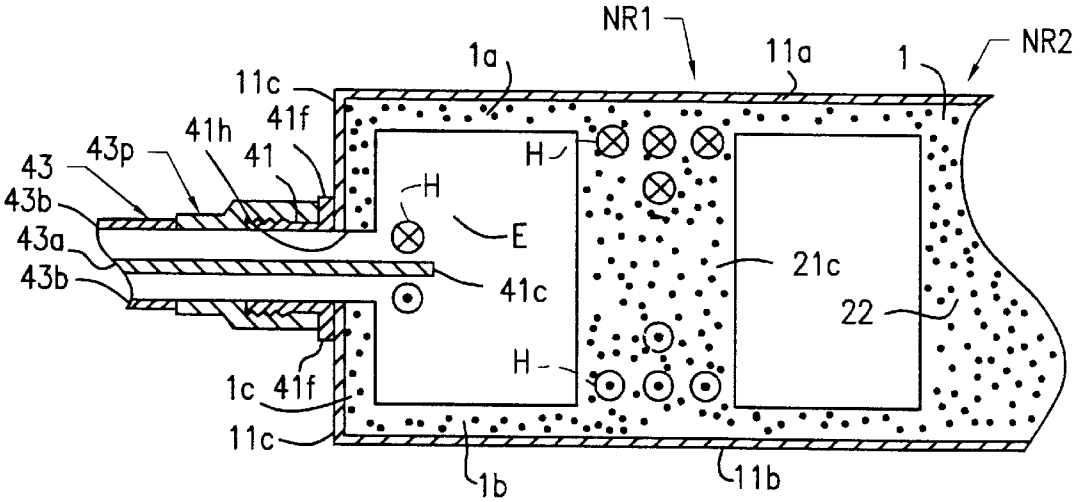
FIG. 9B is a longitudinal sectional view illustrating the magnetic-field distribution of the band-pass filter apparatus in an LSM mode in accordance with the second embodiment, which view is cut by a plane passing the axis parallel to the transmission direction in the coaxial waveguide.
Figure 10A:
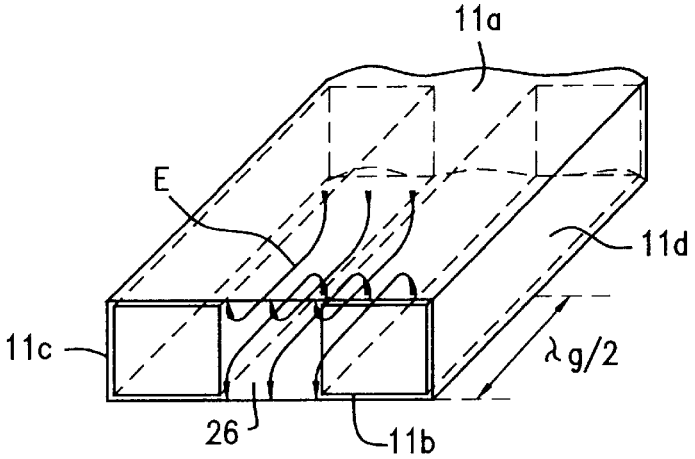
FIG. 10A is a perspective view illustrating the electric-field distribution of an $LSE_{01}$ mode transmission waveguide.
Figure 10B:
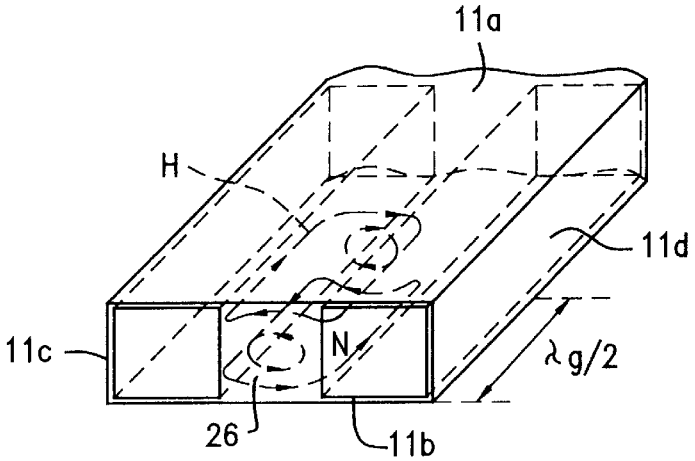
FIG. 10B is a perspective view illustrating the magnetic-field distribution of the $LSE_{01}$ mode transmission waveguide.
Figure 10C:
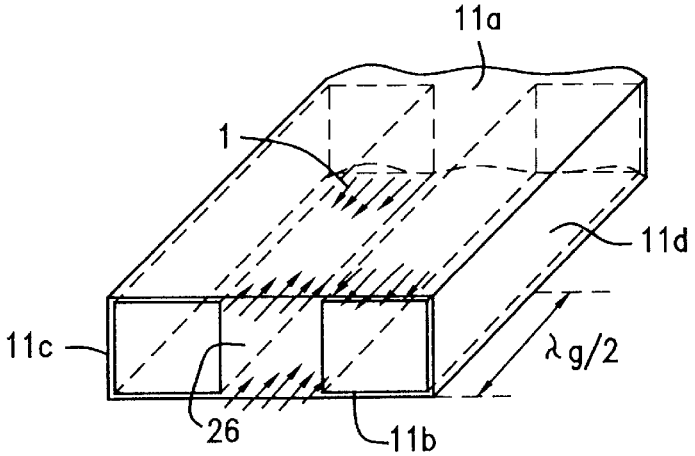
FIG. 10C is a perspective view illustrating the electric-current distribution of the $LSE_{01}$ mode transmission waveguide.

As shown in FIGS. 2, 9A, and 9B, in the central portion of the end surface portion 1*c* on the side, a circular-shaped hole 41*h* is formed so as to open along the thickness direction of the end surface portion 1*c* and the electrode 11*c*. A coaxial connector 41 having a center conductor 41*c* is secured in the hole 41*h* by a ring 41*f* of the coaxial connector 41. A coaxial plug 43*p* is attached to the end portion of the coaxial waveguide 43 comprising a center conductor 43*a* and a grounding conductor 43*b*, and the coaxial plug 43*p* is inserted into the coaxial connector 41, thus the coaxial waveguide 43 is connected to the coaxial connector 41. Here, the center conductor 43*a* of the coaxial waveguide 43 is connected to the center conductor 41*c* of the coaxial connector 41, and the grounding conductor 43*b* of the coaxial waveguide 43 is connected to the electrode 11*c* via the ring 41*f* of the coaxial connector 41.

Likewise, in the central portion of the end surface portion 1*d* on the side, a circular-shaped hole (not shown) is formed so as to open along the thickness direction of the end surface portion 1*d* and the electrode 11*d*, a coaxial connector 42 is inserted into that hole, and a coaxial waveguide (not shown) is connected to the coaxial connector 42.

Figure 7C:
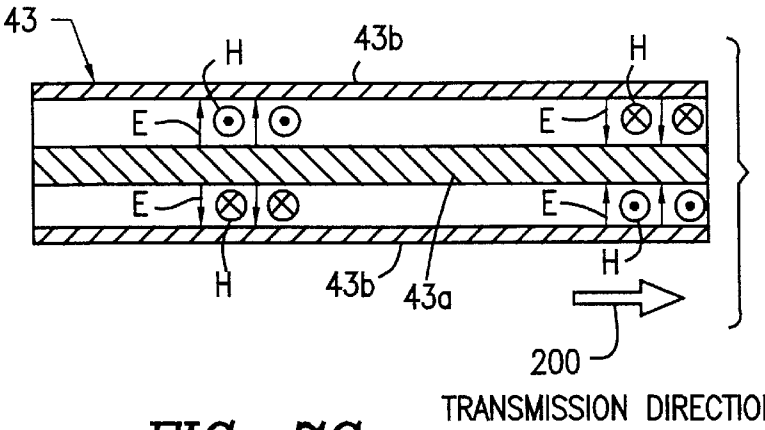
FIG. 7C is a longitudinal sectional view illustrating the transmission electromagnetic-field distribution of a coaxial waveguide in the band-pass filter apparatus in accordance with the second embodiment, which view is cut by a plane passing the axis parallel to the transmission direction in the rectangular waveguide.

The transmission electromagnetic-field distribution in the coaxial waveguide 43 is as shown in FIG. 7C. The coaxial waveguide 43 is electromagnetically coupled to the $LSM_{01}$ mode resonator NR1 at the initial stage via the coaxial connector 41 as shown in FIGS. 9A and 9B. In a similar manner, the $LSM_{01}$ mode resonator NR5 at the final stage is electromagnetically coupled to the coaxial waveguide via the coaxial connector. That is, the $LSM_{01}$ mode resonator is coupled to the coaxial waveguide having a TEM transmission mode. This is because the electromagnetic-field vector when the $LSM_{01}$ mode resonator is observed from the end surface thereof coincides satisfactorily with the electromagnetic-field within the cross-section in the TEM mode. More specifically, the electric-field vector of the coaxial waveguide 43 has radius vector components which expand radially, the magnetic-field vector thereof has components in the direction of coaxial rotation, and they intersect at right angles to each other. As described above, since the shape of the electromagnetic-field vector of the $LSM_{01}$ mode of the resonator is similar to that of the cross-sectional electromagnetic-field vector of the transmission mode, an easy-to-connect structure is formed as an input/output structure.

First Modified Embodiment

Figure 3:
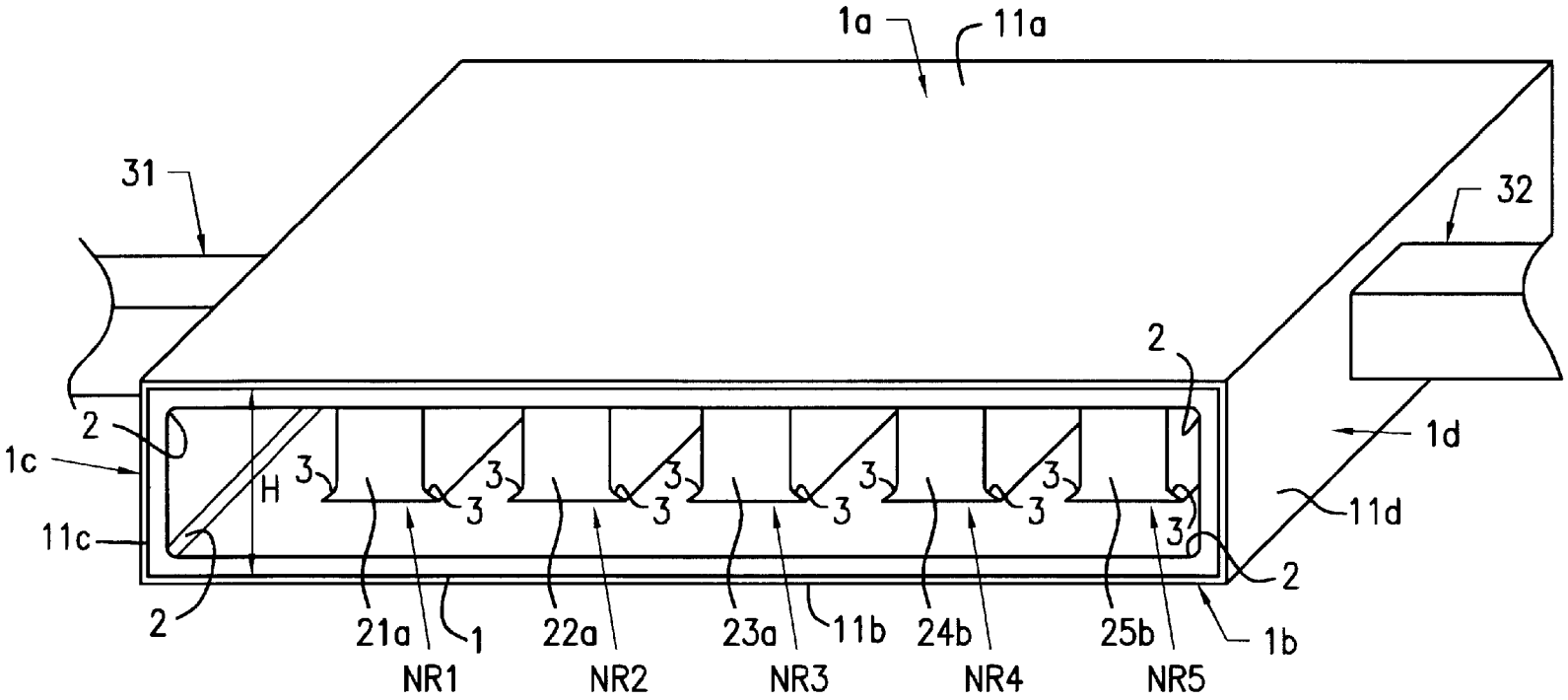
FIG. 3 is a perspective view illustrating the exterior of an integrated NRD waveguide superconducting band-pass filter apparatus according to a first modified embodiment of the present invention.

FIG. 3 is a perspective view illustrating the exterior of an integrated NRD waveguide superconducting band-pass filter apparatus according to a first modified embodiment of the present invention. In this first modification, as compared with the first embodiment, corners 2 at the connections between the upper surface portion 1*a* and the end surface portions 1*c* and 1*d* and between the lower surface portion 1*b* and the end surface portions 1*c* and 1*d* are chamfered so as to form a slope. Also, the bonding portions 3 between the dielectric waveguides 21*a*, 22*a*, 23*a*, 24*b* and 25*b* and the upper and lower surface portions 1*a* and 1*b* are chamfered to be rounded so that curved surfaces are formed from the side surfaces of the dielectric waveguides 21*a*, 22*a*, 23*a*, 24*b* and 25*b* to the upper surface portion 1*a* and the lower surface portion 1*b*. As a result, the effect of preventing cracks when stresses occur in dielectric materials, and the effect of increasing mechanical strength can be expected. Stresses can occur in dielectric materials in cases where a sharp, partial temperature change occurs, for example, a local increase in temperature when an electrode film is formed, causing a part of the electrode to expand, or a local decrease in temperature when a superconducting filter is cooled to about 77° K, causing a part of the superconducting filter to contract. Forming a dielectric integrated type superconducting band-pass filter apparatus in the above-described way makes stable operation possible when this apparatus is cooled from room temperature (about 300° K) to nitrogen temperature (about 77° K) so as to operate at a low temperature.

The chamfering in the above-described first modification may be performed so as to form a slope or plane surface, in addition to a curved surface.

General Features

The operation of the filter apparatus of the first and second embodiments is as follows.

(1) Such filters operate as band-pass filters in the microwave and millimeter-wave band.

(2) Superconducting electrodes operate with low loss at low temperatures.

(3) NRD waveguides having predetermined dimensions resonate at an integral multiple of a half-wavelength, and their ambient regions operate as cut-off regions.

(4) Resonance current concentrates in the electrodes 11*a* and 11*b* on the upper and lower surfaces of the NRD waveguide, and electric current to the electrode edge portions is not present.

(5) Such filters operate with the same effects and advantages with respect to two independent modes, LSE and LSM.

The details of the effects and advantages of the first and second embodiments are as follows.

(1) High Reliability

Linear expansion coefficients of ceramic materials are shown in Table 1, and linear expansion coefficients of metallic materials are shown in Table 2.

TABLE 1

Linear expansion coefficients of ceramic materials

| Ceramic Materials | Specific Inductive Capacity $\epsilon r$ | Linear Expansion Coefficient ppm/°K. |
|---|---|---|
| $(Zr,Sn)TiO_4$ | 38 | 6 to 7 |
| $Ba(Sn,Mg,Ta)O_3$ | 24 | 10.7 |

TABLE 2

Linear expansion coefficients of metallic materials (Cited from "Science Chronological Table" (1995) edited by Japanese National Astronomical Observatory)

| Metallic materials | 100° K. | 293° K. |
|---|---|---|
| Copper | 10.3 | 16.5 |
| Brass | — | 17.5 |
| Stainless steel | 11.4 | 14.7 |

As is clear from Tables 1 and 2, ceramic materials, such as $(Zr,Sn)TiO_4$ or $Ba(Sn,Mg,Ta)O_3$, have a linear expansion coefficient substantially smaller than that of metallic materials. Further, since each section is formed integrally in the dielectric housing 1 made from ceramic materials, the linear expansion coefficient of the present dielectric housing 1 is constant, and this is deformed analogously when the filter apparatus is cooled. Therefore, even if the apparatus is operated at low temperatures, the reliability of the electrical operations of the filter apparatus is high because internal stress is small, and problems with cracks in the ceramic materials or the like do not occur.

(2) Low-Loss Characteristics

As materials for the dielectric housing 1, dielectric materials with a low loss at low temperatures, such as $Ba(Sn,Mg,Ta)O_3$ or $(Zr,Sn)TiO_4$, are used. Therefore, when a superconducting band-pass filter apparatus is formed, the low-loss characteristics of superconducting electrodes effectively act in determining the performance of the filter. To be specific, when YBCO is used, the surface resistance value is approximately 10 mω at 10 GHz and 50° K. The electrical characteristic values in an example of dielectric materials are as follows.

(2A) $Ba(Sn,Mg,Ta)O_3$: $\epsilon r=24$, $\tan\delta=0.114\times10^{-4}$ (at a frequency of 10 GHz and a temperature of 77° K)

(2B) $(Zr,Sn)TiO_4$: $\epsilon r=38$, $\tan\delta=0.525\times10^{-4}$ (at a frequency of 10 GHz and a temperature of 77° K)

Figure 16:
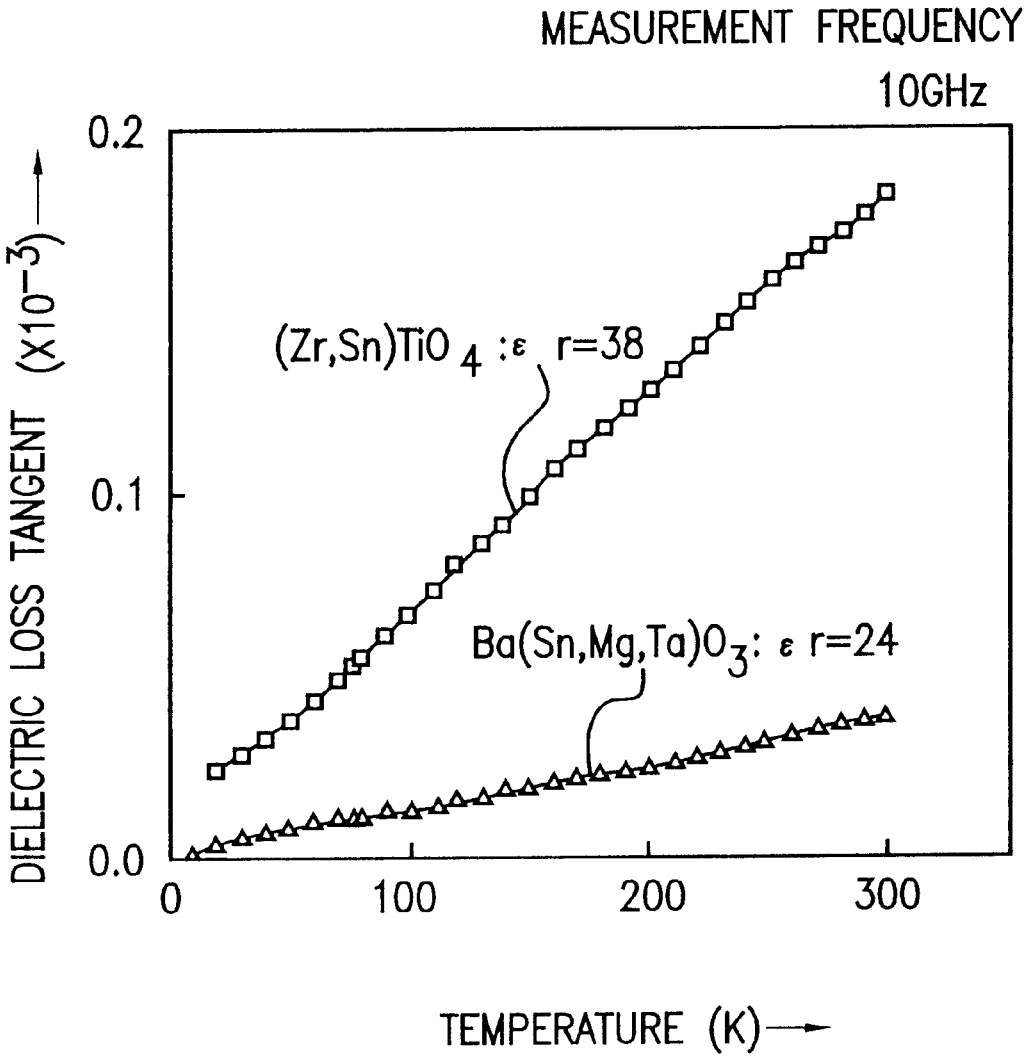
FIG. 16 is a graph illustrating the temperature characteristics of dielectric loss tangent of ceramic materials having low-loss characteristics at low temperatures.

Further, the temperature characteristics of the dielectric loss tangent of the above-described two dielectric materials are shown in FIG. 16. As can be seen in FIG. 16, the dielectric loss tangent is exceedingly small at relatively low temperatures.

(3) Ease of Processing

Figure 17A:
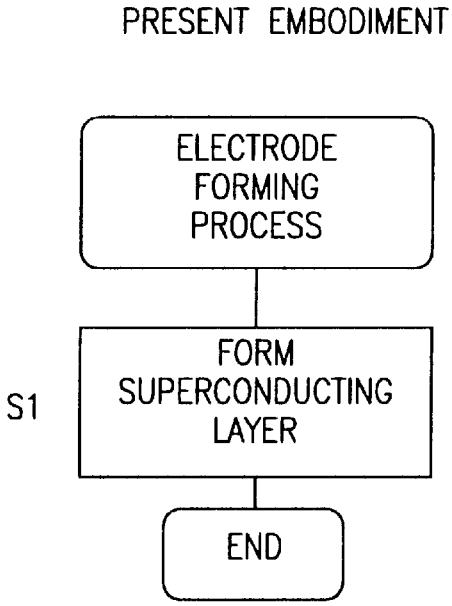
FIG. 17A is a flowchart illustrating the steps in an electrode forming process in the superconducting band-pass filter apparatus in accordance with this embodiment.
Figure 17B:
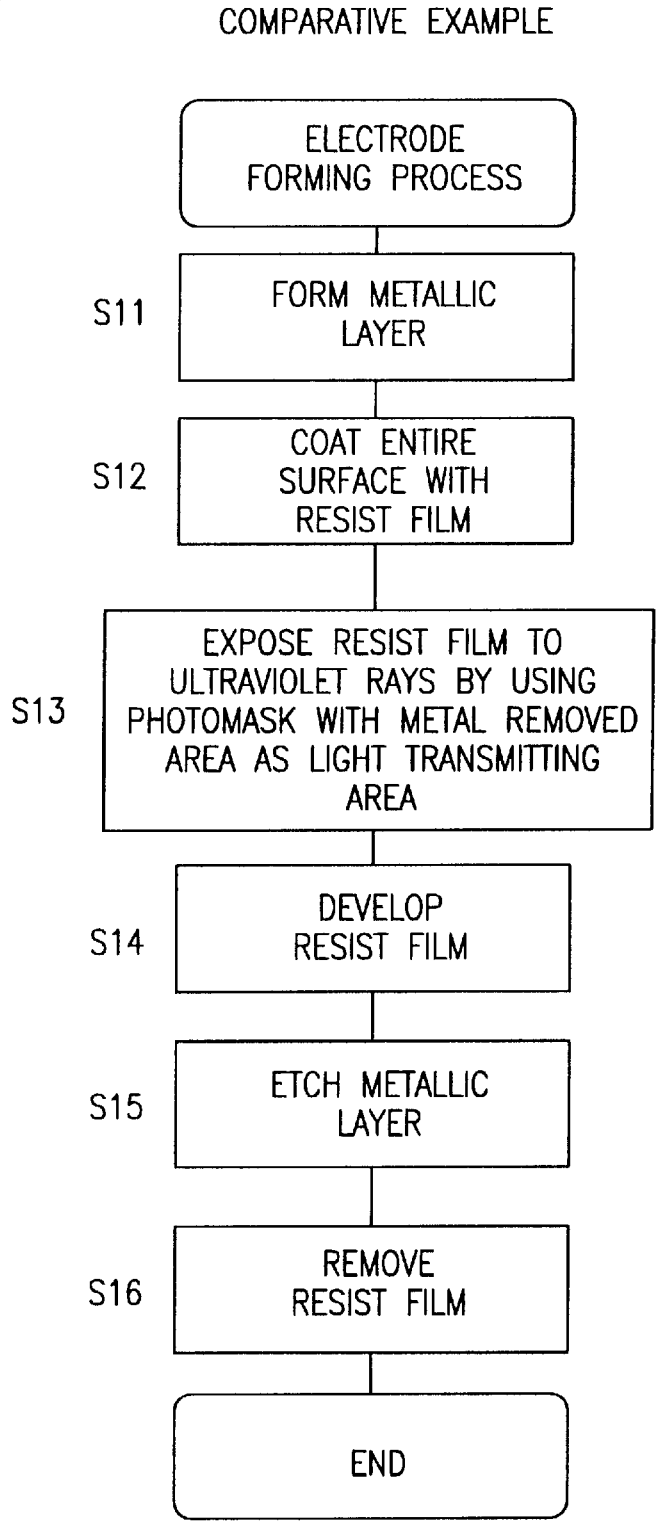
FIG. 17B is a flowchart illustrating the steps in an electrode forming process in the band-pass filter apparatus employing microstrip line resonators in accordance with a conventional example.
Figure 18A:
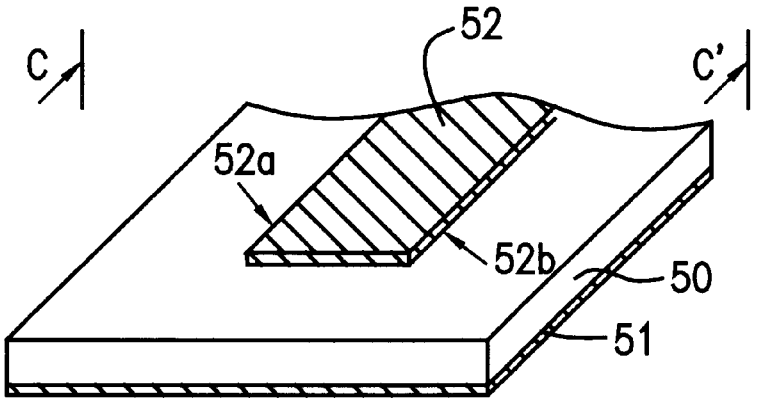
(PRIOR ART) FIG. 18A
FIG. 18A is a perspective view illustrating the exterior of the conventional microstrip line resonator.

For example, in order to form a microstrip line resonator of the conventional comparative example shown in FIG. 18A, six steps, steps S11, S12, S13, S14, S15 and S16, are required, as shown in FIG. 17B. On the other hand, for superconducting electrodes of this embodiment, only the upper and lower electrodes 11*a* and 11*b* of the present apparatus need to be formed; therefore, as shown in FIG. 17A, it is possible to use only one step S1, which is a simple film-forming process on a flat surface. Further, since fine-pattern processing is not required, processing accuracy does not pose a problem, and the reliability of processing is high.

(4) Electric-Power Resistivity

Figure 18B:
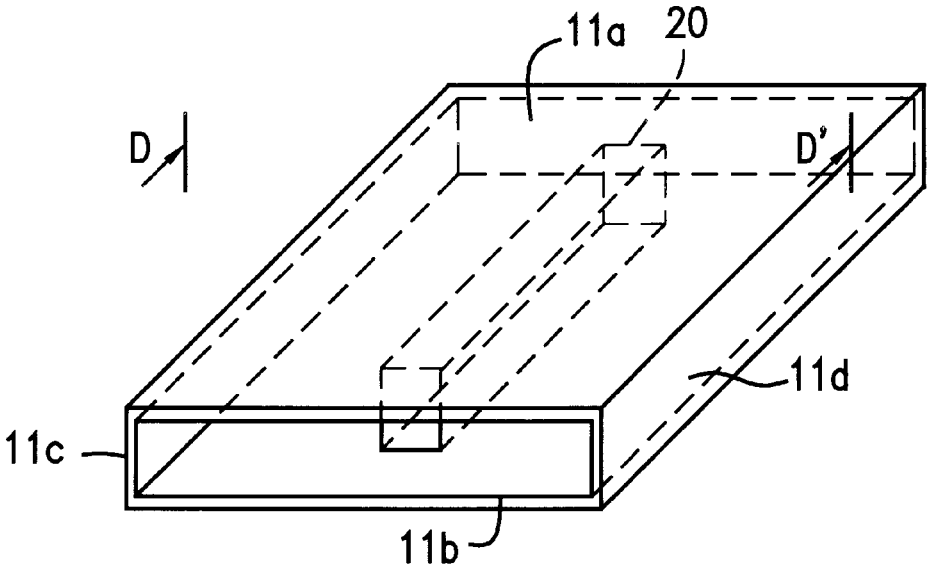
FIG. 18B is a perspective view illustrating the exterior of the NRD waveguide resonator.
Figure 19:
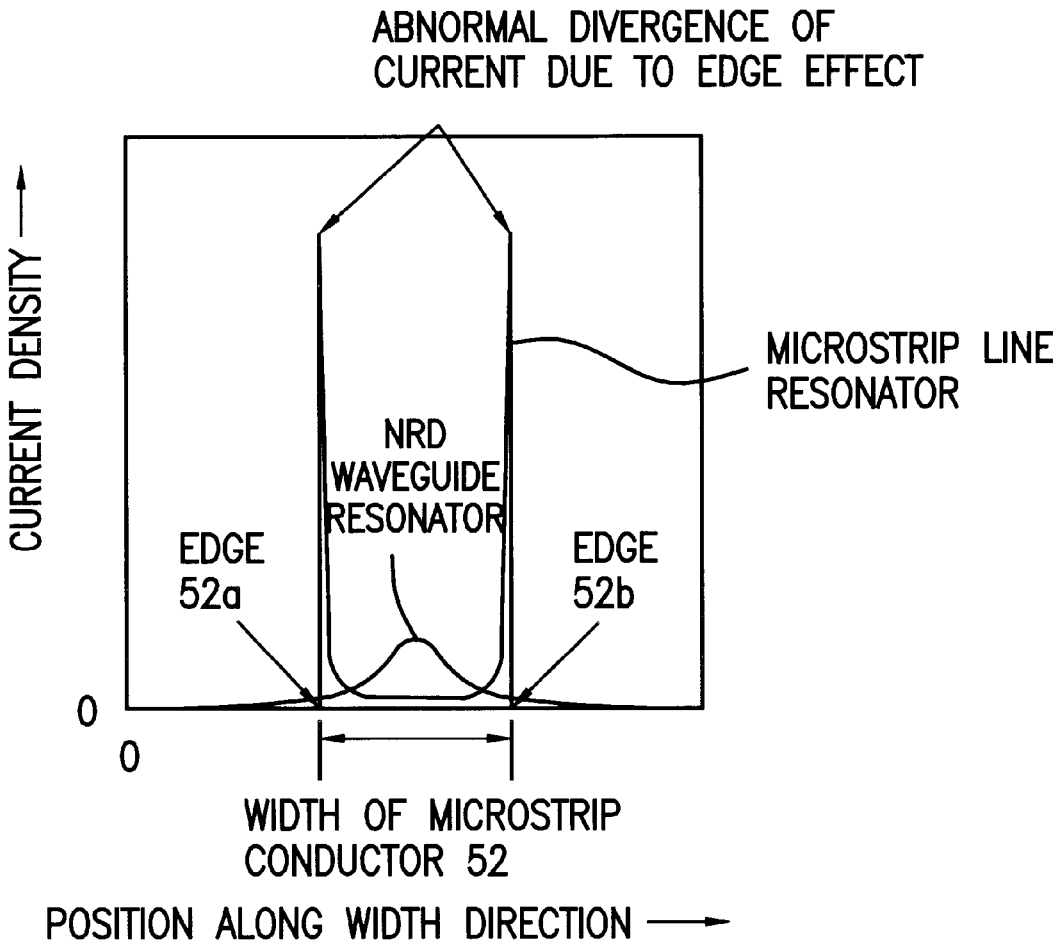
FIG. 19 is a graph illustrating the current density with respect to the position along the width direction (C-C' in FIG. 18A, and D-D' in FIG. 18B) in the conventional microstrip line resonator in FIG. 18A and in the NRD waveguide resonator in FIG. 18B.

FIG. 19 is a graph illustrating the current density with respect to the position along the width direction in the microstrip line resonator of the conventional comparative example shown in FIG. 18A and the NRD waveguide resonator of the embodiment shown in FIG. 18B. As is clear from FIG. 19, in the comparative example, abnormal divergence of electric current appears due to the edge effect in edge portions 52*a* and 52*b*, and a superconducting state is destroyed in the edge portions when superconducting electrodes are used; however, in the embodiment, there is no abnormal current concentration at the electrode edge portions due to the edge effect. Therefore, even if a large power is input to the superconducting band-pass filter apparatus at the critical current density (Jc) or less of the superconducting electrode, the filter apparatus is able to operate, and thus it can easily cope with a large amount of power.

(5) Low-Distortion Characteristics

As described above, since there is no abnormal current concentration in the electrode edge portions due to the edge effect, the linearity of electric power is improved. For example, the mutual modulation distortion becomes small.

(6) Small-Size Designability

Figure 20A:
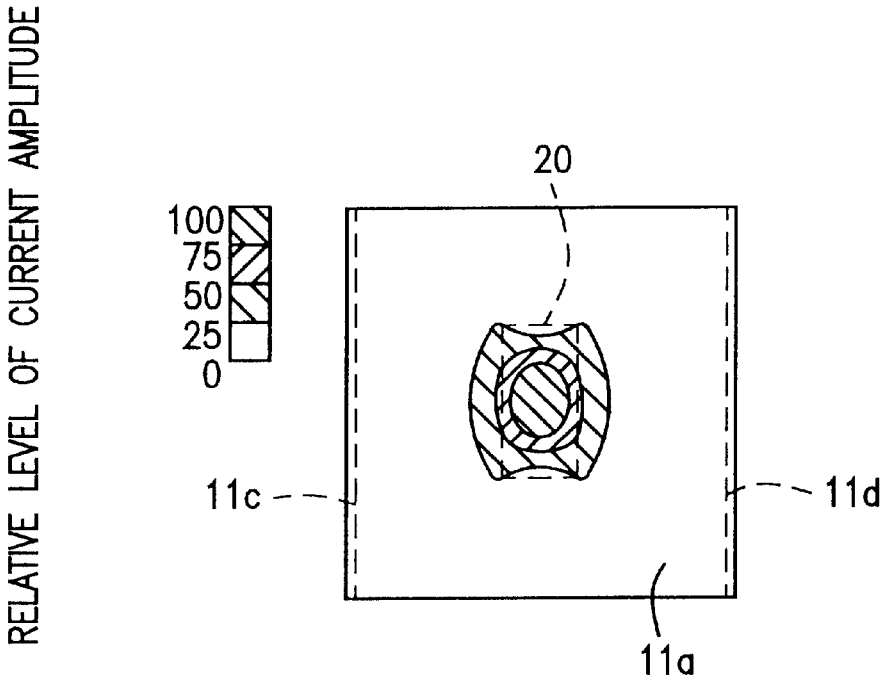
FIG. 20A is a plan view illustrating the current density distribution of the NRD waveguide resonator.
Figure 20B:
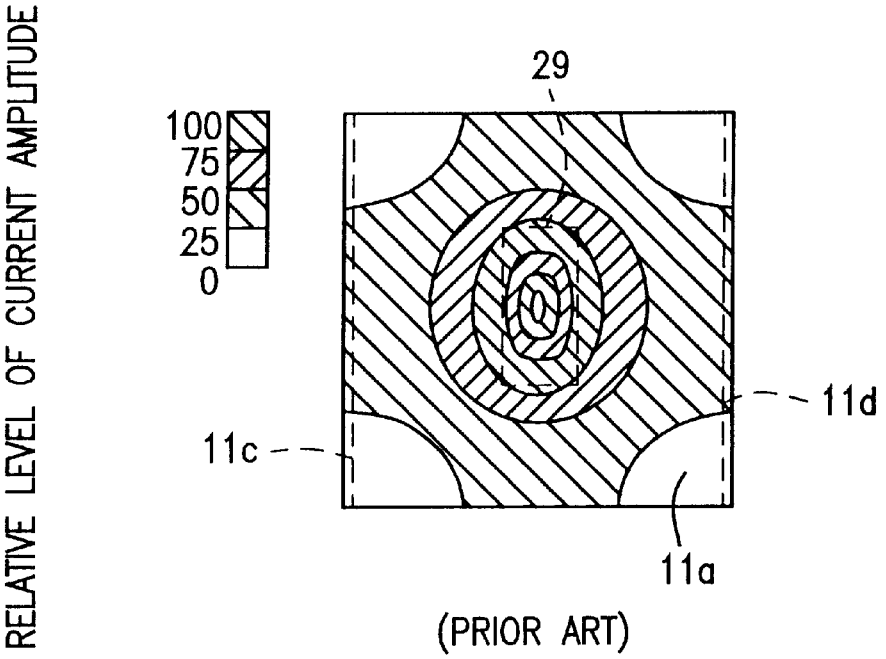
(PRIOR ART) FIG. 20B
FIG. 20B is a plan view illustrating the current density distribution of the conventional $TM_{11}$ mode resonator.

As is clear from FIG. 20A which illustrates the relative level of the current amplitude with respect to the maximum value of the current amplitude, in the NRD waveguide resonator of this embodiment, energy concentrates in the dielectric waveguide, as compared with the $TM_{11}$ mode resonator of the conventional comparative example as shown in FIG. 20B and the attenuation is rapid in the ambient cut-off region. Therefore, it is possible to set the coupling coefficient K between the resonators to be smaller than that of the TM mode resonator, and the filter apparatus can be made smaller in size and lighter in weight than the TM mode resonator.

(7) Thin-Type Designability

The insertion loss of the band-pass filter apparatus is almost inversely proportional to the space H between the upper and lower plane electrodes 11*a* and 11*b*; however, thin-type design is made possible by forming the plane electrodes to be superconductive.

(8) Hybrid Formation With Plane Circuit

Figure 4:
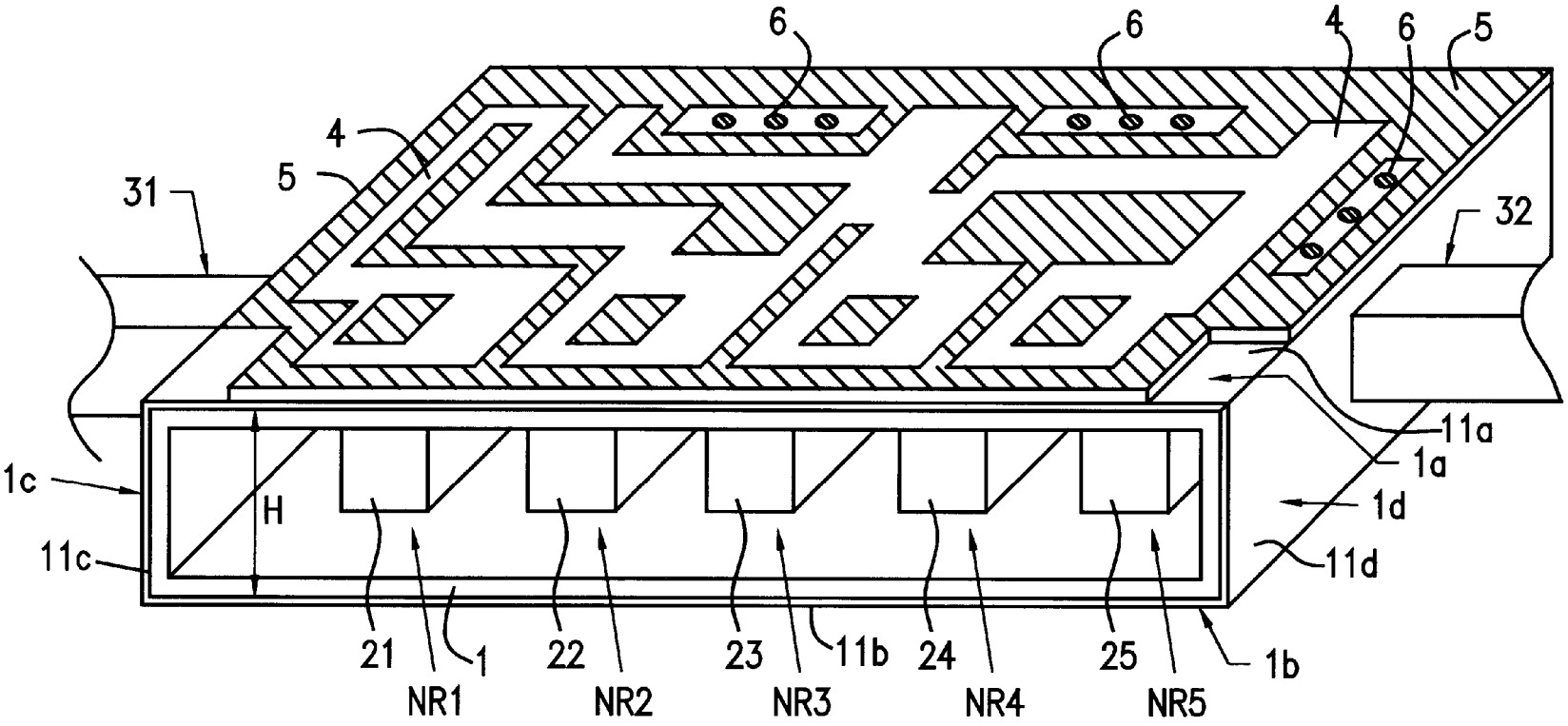
FIG. 4 is a perspective view illustrating the exterior of an integrated NRD waveguide superconducting band-pass filter apparatus according to a second modified embodiment of the present invention.

In a second modified embodiment as shown in FIG. 4, the surfaces of the superconducting electrodes 11*a* and 11*b* can be used in common as grounding electrodes of the other plane circuits. Therefore, it is possible to form on the surface of the filter apparatus high-frequency signal processing circuit modules, for example, oscillation circuits, frequency conversion circuits, multiplication circuits or amplification circuits. In the example shown in FIG. 4, after a dielectric layer 4 is formed on the superconducting electrode 11*a*, a pattern electrode 5 and a terminal electrode 6 are formed on the dielectric layer 4, thus forming a plane circuit.

Although the above embodiments describe a band-pass filter apparatus with a five-stage structure, the present invention is not limited to this example and may be a band-pass filter apparatus with as few as one stage.

Although the above embodiments describe a case in which superconducting electrodes 11*c* and 11*d* are formed on the sides or on the end surfaces, the present invention is not limited to this example, and these electrodes may not be formed.

Each parameter in the embodiment of the superconducting band-pass filter apparatus employing the $LSE_{01}$ mode resonator of the first embodiment is shown below.

(a) Number of filter stages: 5
(b) Center frequency: 12 GHz
(c) Designed band width: 24 MHz
(d) Ripple: 0.01 dB
(e) Operating temperature: 77° K
(f) Specific inductive capacity of dielectric materials: 24
(g) Space H between superconducting electrodes: 5.0 mm
(h) Width W of dielectric waveguides: 2.5 mm
(i) Space S between dielectric waveguides: 6.0 mm
(j) Length L of dielectric waveguides: 4.2 mm
(k) Filter exterior dimensions=height: 7.0 mm; width: 60.0 mm; depth: 15.0 mm The inventors of the present invention constructed a band-pass filter apparatus according to the first embodiment having the above parameters.

In this embodiment, the width W, the space S and the length L of the dielectric waveguides are fixed values; however, needless to say, this embodiment may be embodied by adjusting the respective dimensions for the purpose of adjusting its various characteristics.

As described above in detail, it is possible with this invention to provide an NRD waveguide band-pass filter apparatus which is simple in construction and which can be easily manufactured as well as being formed small in size and light in weight, and which operates in a single operating mode.

Further, the interior of the present band-pass filter apparatus can be electromagnetically shielded from the outside, so it is possible to prevent entry of interference and disturbing waves from the outside, and thus the band-pass filter apparatus operates stably.

Moreover, forming a dielectric integrated type superconducting band-pass filter apparatus in the above-described way makes stable operation possible when the apparatus is cooled from room temperature (about 300° K) to nitrogen temperature (about 77° K) for low-temperature operation.

Also, a plane circuit module for high-frequency signal processing can be formed on the surface of the filter apparatus, and the entire apparatus can be formed small in size and light in weight.

Many different embodiments of the present invention may be constructed without departing from the spirit and scope of the present invention. It should be understood that the present invention is not limited to the specific embodiments described in this specification. To the contrary, the present invention is intended to cover various modifications and equivalent arrangements included within the spirit and scope of the invention as hereafter claimed. The scope of the following claims is to be accorded the broadest interpretation so as to encompass all such modifications, equivalent structures and functions.

What is claimed is:

1. An integrated nonradiative dielectric waveguide band-pass filter apparatus comprising:

a hollow housing including upper and lower opposed surfaces;

at least two dielectric strips disposed between said upper and lower surfaces, the upper surface, the lower surface and the dielectric strips being integral with each other; and first and second conductors disposed on said upper and lower surfaces respectively, the spacing between the first and second electrodes being one-half or less of a wavelength corresponding to a resonance frequency in a vacuum of said band-pass filter apparatus;

wherein said band-pass filter apparatus further comprises a plane circuit disposed on said upper surface, said plane circuit including at least a portion of said first conductor.

2. An integrated nonradiative dielectric (NRD) waveguide superconducting band-pass filter apparatus having a plurality of NRD waveguide resonators arrayed with each two adjacent NRD waveguide resonators electromagnetically coupled to each other, said integrated NRD waveguide superconducting band-pass filter apparatus comprising:

a hollow dielectric housing which is rectangular in cross-section and comprises an upper surface portion and a lower surface portion which are parallel to each other, and said plurality of NRD waveguide resonators which are arrayed between the upper surface portion and the lower surface portion;

the upper surface portion, the lower surface portion, and the plurality of NRD waveguide resonators being integral with each other; and a first superconducting electrode and a second superconducting electrode disposed respectively on outer surfaces of the upper surface portion and the lower surface portion, wherein the spacing between the first and second superconducting electrodes is one-half or less of a wavelength corresponding to a resonance frequency in a vacuum of said band-pass filter apparatus, such that regions between the plurality of NRD waveguide resonators define cut-off regions;

wherein said dielectric housing further comprises two end surface portions disposed in such a manner as to connect respective longitudinal ends of the upper surface portion and the lower surface portion, and said band-pass filter apparatus further comprises third and fourth electrodes disposed respectively on outer surfaces of said two end surface portions.

3. An integrated NRD waveguide superconducting band-pass filter apparatus according to claim 2, wherein connecting portions between the upper surface portion, the lower surface portion and the two end surface portions of said dielectric housing, and connecting portions between each said NRD waveguide resonator and said upper and lower surface portions, define respective corners.

4. An integrated nonradiative dielectric waveguide band-pass filter apparatus according to claim 3, wherein said corners are non-right-angle corners.

5. An integrated nonradiative dielectric waveguide band-pass filter apparatus according to claim 3, wherein said corners are chamfered.

6. An integrated nonradiative dielectric waveguide band-pass filter apparatus according to claim 5, wherein said chamfered corners define respective slopes.

7. An integrated nonradiative dielectric waveguide band-pass filter apparatus according to claim 5, wherein said chamfered corners define respective plane surfaces.

8. An integrated nonradiative dielectric waveguide band-pass filter apparatus according to claim 5, wherein said chamfered corners define respective curved surfaces.

9. An integrated NRD waveguide superconducting band-pass filter apparatus according to claim 3, wherein said band-pass filter apparatus further comprises a plane circuit disposed on the outer surface of said upper surface portion, said plane circuit including at least a portion of said first superconducting electrode.

10. An integrated NRD waveguide superconducting band-pass filter apparatus according to claim 2, wherein said band-pass filter apparatus further comprises a plane circuit disposed on the outer surface of said upper surface portion, said plane circuit including at least a portion of said first superconducting electrode.

11. An integrated nonradiative dielectric (NRD) waveguide superconducting band-pass filter apparatus having a plurality of NRD waveguide resonators arrayed with each two adjacent NRD waveguide resonators electromagnetically coupled to each other, said integrated NRD waveguide superconducting band-pass filter apparatus comprising:

a hollow dielectric housing which is rectangular in cross-section and comprises an upper surface portion and a lower surface portion which are parallel to each other, and said plurality of NRD waveguide resonators which are arrayed between the upper surface portion and the lower surface portion;

the upper surface portion, the lower surface portion, and the plurality of NRD waveguide resonators being integral with each other; and a first superconducting electrode and a second superconducting electrode disposed respectively on outer surfaces of the upper surface portion and the lower surface portion, wherein the spacing between the first and second superconducting electrodes is one-half or less of a wavelength corresponding to a resonance frequency in a vacuum of said band-pass filter apparatus, such that regions between the plurality of NRD waveguide resonators define cut-off regions;

wherein said band-pass filter apparatus further comprises a plane circuit disposed on the outer surface of said upper surface portion, said plane circuit including at least a portion of said first superconducting electrode.

12. An integrated nonradiative dielectric waveguide band-pass filter apparatus comprising:

a hollow housing including upper and lower opposed surfaces;

at least two dielectric strips disposed between said upper and lower surfaces, the upper surface, the lower surface and the dielectric strips being integral with each other; and first and second conductors disposed on said upper and lower surfaces respectively, the spacing between the first and second electrodes being one-half or less of a wavelength corresponding to a resonance frequency in a vacuum of said band-pass filter apparatus;

wherein connecting portions between each said dielectric strip and said upper and lower surface portions define non-right-angle corners.

13. An integrated nonradiative waveguide band-pass filter apparatus according to claim 12, wherein said band-pass filter apparatus further comprises a plane circuit disposed on said upper surface, said plane circuit including at least a portion of said first conductor.

14. An integrated nonradiative dielectric waveguide band-pass filter apparatus comprising:

a hollow housing including upper and lower opposed surfaces;

at least two dielectric strips disposed between said upper and lower surfaces, the upper surface, the lower surface and the dielectric strips being integral with each other; and first and second conductors disposed on said upper and lower surfaces respectively, the spacing between the first and second electrodes being one-half or less of a wavelength corresponding to a resonance frequency in a vacuum of said band-pass filter apparatus;

wherein said housing further comprises two end surfaces which connect respective longitudinal ends of the upper surface and the lower surface, and said band-pass filter apparatus further comprises third and fourth electrodes disposed respectively on said two end surfaces.

15. An integrated nonradiative waveguide band-pass filter apparatus according to claim 14, wherein said band-pass filter apparatus further comprises a plane circuit disposed on said upper surface, said plane circuit including at least a portion of said first conductor.

16. An integrated nonradiative dielectric waveguide band-pass filter apparatus according to claim 14, wherein connecting portions between the upper surface and the lower surface of said housing and said two end surfaces, and connecting portions between each said dielectric strip and said upper and lower surface portions, define non-right-angle corners.

17. An integrated nonradiative waveguide band-pass filter apparatus according to claim 16, wherein said band-pass filter apparatus further comprises a plane circuit disposed on said upper surface, said plane circuit including at least a portion of said first conductor.

18. An integrated nonradiative dielectric (NRD) waveguide superconducting band-pass filter apparatus having a plurality of NRD waveguide resonators arrayed with each two adjacent NRD waveguide resonators electromagnetically coupled to each other, said integrated NRD waveguide superconducting band-pass filter apparatus comprising:

a hollow dielectric housing which is rectangular in cross-section and comprises an upper surface portion and a lower surface portion which are parallel to each other, and said plurality of NRD waveguide resonators which are arrayed between the upper surface portion and the lower surface portion;

the upper surface portion, the lower surface portion, and the plurality of NRD waveguide resonators being integral with each other; and a first superconducting electrode and a second superconducting electrode disposed respectively on outer surfaces of the upper surface portion and the lower surface portion, wherein the spacing between the first and second superconducting electrodes is one-half or less of a wavelength corresponding to a resonance frequency in a vacuum of said band-pass filter apparatus, such that regions between the plurality of NRD waveguide resonators define cut-off regions;

wherein connecting portions between each said NRD waveguide resonator and said upper and lower surface portions define respective corners.

19. An integrated nonradiative dielectric waveguide band-pass filter apparatus according to claim 18, wherein said corners are non-right-angle corners.

20. An integrated nonradiative dielectric waveguide band-pass filter apparatus according to claim 18, wherein said corners are chamfered.

21. An integrated nonradiative dielectric waveguide band-pass filter apparatus according to claim 20, wherein said chamfered corners define respective slopes.

22. An integrated nonradiative dielectric waveguide band-pass filter apparatus according to claim 20, wherein said chamfered corners define respective plane surfaces.

23. An integrated nonradiative dielectric waveguide band-pass filter apparatus according to claim 20, wherein said chamfered corners define respective curved surfaces.

24. An integrated NRD waveguide superconducting band-pass filter apparatus according to claim 18, wherein said band-pass filter apparatus further comprises a plane circuit disposed on the outer surface of said upper surface portion, said plane circuit including at least a portion of said first superconducting electrode.

* * * * *